US006314687B1

(12) United States Patent
Schondelmayer et al.

(10) Patent No.: US 6,314,687 B1
(45) Date of Patent: Nov. 13, 2001

(54) WALL PANEL COVERING

(76) Inventors: Gerald Schondelmayer, 10483 Acorn La., West Olive, MI (US) 49460; Richard Weise, 9846 Leonard Rd., Coopersville, MI (US) 49404

( * ) Notice: Subject to any disclaimer, the term of this patent is extended or adjusted under 35 U.S.C. 154(b) by 0 days.

(21) Appl. No.: 09/570,146

(22) Filed: May 12, 2000

Related U.S. Application Data

(62) Division of application No. 08/864,459, filed on May 28, 1997, now abandoned.
(60) Provisional application No. 60/018,956, filed on Jun. 7, 1996.

(51) Int. Cl.[7] ..... E04H 1/00
(52) U.S. Cl. ..... 52/63; 52/511; 52/239; 52/36.1; 52/145; 160/385; 160/354; 160/351
(58) Field of Search ..... 52/63, 511, 783.1, 52/791.1, 273, 222, 239, 36.1, 145; 160/385, 390, 394, 354, 328, 351

(56) References Cited

U.S. PATENT DOCUMENTS

| | | | | |
|---|---|---|---|---|
| 1,903,469 | * | 4/1933 | Meader | 52/511 |
| 2,238,187 | | 4/1941 | Sanchez . | |
| 2,692,017 | | 10/1954 | Lang . | |
| 3,205,628 | * | 9/1965 | Frisk | 52/222 |
| 3,719,013 | * | 3/1973 | Blick | 52/222 |
| 4,197,686 | | 4/1980 | Baslow . | |
| 4,252,365 | * | 2/1981 | Ferguson | 52/222 X |
| 4,403,642 | | 9/1983 | Morris . | |
| 4,625,490 | | 12/1986 | Baslow . | |
| 4,784,205 | | 11/1988 | Johnson et al. . | |
| 4,980,934 | * | 1/1991 | Dahowski et al. | 52/222 X |
| 5,024,030 | * | 6/1991 | Morrison | 52/36.1 |
| 5,029,422 | * | 7/1991 | Scherrer | 52/222 |
| 5,058,340 | * | 10/1991 | Muller | 52/222 |
| 5,129,202 | | 7/1992 | Payne et al. . | |
| 5,172,530 | * | 12/1992 | Fishel et al. | 52/36.1 |
| 5,174,086 | | 12/1992 | Payne et al. . | |
| 5,216,859 | | 6/1993 | Moreno et al. . | |
| 5,979,968 | * | 11/1999 | Essig et al. | 52/222 X |

* cited by examiner

*Primary Examiner*—Beth A. Stephan
*Assistant Examiner*—Brian E. Glessner

(57) ABSTRACT

A wall panel including a rectangular frame, a pair of wall members and a thin decorative sheet covering the wall members. The frame includes two spaced apart, generally parallel vertical frame members and spaced apart, generally parallel horizontal lower and upper frame members. The horizontal frame members are connected to the vertical frame members at opposite ends thereof to form the rectangular frame. Each of the frame members includes a core member and a pair of sidewall members attached to opposite sides of the core member. The wall members are attached to the sidewalls on opposing sides of the frame members. A decorative sheet covers the outer surface of each wall member. A method for manufacturing the frame members includes providing a fixture with spaced apart first, second and third surfaces. A hanger bracket is mounted to the vertical frame core member and is positioned in the fixture such that the hanger bracket engages the first surface. The sidewalls are positioned on opposite sides of the core in the fixture and engage the second surface. The sidewalls are attached to the core member. A method for making the panel includes providing a fixture. The frame members are inserted in the fixture so that each one engages a fixture surface. A wall member is mounted on each side of the frame, with a filler member disposed inside the frame between the wall members.

26 Claims, 28 Drawing Sheets

WALL PANEL COVERING

This application is a divisional of U.S. patent application Ser. No. 08/864,459, filed May 28, 1997, now abandoned, which claims the benefit of U.S. Provisional Application No. 60/018,956 filed Jun. 7, 1996, the entire disclosures of which are hereby incorporated herein by reference.

BACKGROUND OF THE INVENTION

The present invention relates generally to a wall panel system, and in particular, to an improved wall panel, components therefore and a method for making the wall panel.

Panel systems are commonly used to divide large, open office space into separate work spaces. For example, Herman Miller, Inc., the assignee of the present application, manufacturers and sells two such work space management systems: the ACTION OFFICE® system and the ETHOSPACE® system. Often, wall panels arranged in such systems include an internal frame with a sheet of wall board or comparable material attached to the side of the frame. Typically, the frame is made from roll-formed or extruded metal, with the wall board adhesively secured to the side of the metal frame members. Each side of the wall panel usually is covered with a fabric that is either bonded to the frame, or attached with an elastic band, so as to provide an aesthetically pleasing appearance to the user.

Adjacent wall panels in the system typically are connected to one another with a variety of connector assemblies. For example, wall panels placed end-to-end commonly are connected to each other, while wall panels oriented perpendicular to each other in a two-way, three-way or four-way configuration typically are connected to a corner post located at the junction of the intersecting panels. Typically, a cover is attached to those sides of the corner post not connected to a wall panel so as to provide an aesthetically pleasing surface that matches the surface of the adjacent panels.

Wall panels often are provided with wire management capabilities, typically including horizontal wire channels positioned at the top and bottom of the panel. Wall panels may also include vertical channels, typically formed by the vertical frame members, that extend between the top and bottom of the panel. Typically, wall panels having a horizontal channel at the top of the panel also provide a top cap to cover the channel. When a corner post is interposed between panels, a cap also is installed on top of the corner post to provide a continuous, unbroken line across the top of a system of wall panels.

Wall panels may also include power distribution systems, whereby the wall panels can be electrically connected so as to provide the user with access to power in each work space created by the system of wall panels.

SUMMARY OF THE INVENTION

Briefly stated, one aspect of the invention is directed to an improved wall panel. The wall panel includes a rectangular frame, a pair of sheetlike wall members and two thin decorative sheets. The rectangular frame includes, two spaced apart, and generally parallel vertical side frame members and spaced apart and generally parallel horizontal lower and upper frame members. The frame members are connected at opposite ends thereof to form the rectangular frame. Each of the frame members includes a core member and a pair of sidewall members attached to opposite sides of the core member. The sheetlike wall members, preferably made of fiberboard, have an inner surface attached to the side walls of each frame member. The thin decorative sheets, preferably cloth, cover the outer surface of the wall members on each side of the panel.

In a preferred embodiment, the sidewall members include a substantially flat leg portion having an inner surface attached to the core member and an outer surface attached to the wall member. The sidewall member includes an edge portion extending laterally outward from the leg portion. Preferably, the edge portion is configured as a C-shaped channel facing inwardly away from the wall panel surface. When the frame members are assembled into a rectangular frame, the edge portions extend around the periphery of the wall panel. The sidewalls, including the edge portions, form a shallow recess on opposite sides of the panel. Each recess has a bottom surface defined by the outer surface of the leg portions. The wall members are received in the recesses on opposite sides of the panel.

In another aspect of the invention, a thin barrier sheet, or scrim, is disposed between the decorative sheet and the outer surface of the wall member as a fire blocking member. The barrier sheet preferably includes a thin aluminum foil layer laminated to a fiberglass layer.

The wall panel also includes an inner filler member disposed between the wall members. The filler member extends between the upper and lower horizontal frame members. Preferably, the inner surface of the wall members are attached to the filler member.

In a preferred embodiment of the invention, the sidewall members on the upper horizontal frame member extend upwardly from the upper core member to form a horizontal channel running substantially the length of the wall panel. The bottom of the channel is defined by the upper surface of the upper core member and the sides of the channel are defined by the upwardly extending sidewall members. A top cap is releasably secured to the upper frame member to cover the channel.

In one aspect of the invention, the wall panel also includes at least one vertical channel communicating with the upper horizontal channel and a bottom portion of the wall panel. Preferably, the vertical channel is defined by an inner surface of one of the vertical core members, a partition member spaced apart from the inner core surface of the vertical core member and the inner surface of the wall member. Preferably, the partition member extends between the inner surfaces of the opposing wall members and is attached to at least one of the wall members. The partition member also extends substantially between the upper and lower frame members.

In another aspect of the invention, a power distribution system is provided at the base of the wall panel. The power distribution system includes a power distribution server, including a harness and a module receptacle, which is attached to a bottom of the lower frame member. The power distribution system is adapted to be electrically connected with power distribution systems located in adjacent panels. In addition, an outlet box is attached to one of the inner surfaces of the wall members between the upper and lower frame members. The other wall member has an opening provided to allow access to the outlet box. The outlet box is electrically connected to the power distribution system with an electrical conduit disposed in the vertical channel.

In another aspect of the invention, a plastic strip is attached to the decorative sheet at each of its edges. The strip includes a first hook member that is adapted to engage the edge portion of the sidewall member. Preferably, the strip also includes a second hook member that is adapted to receive a tool member which can be used to stretch the decorative sheet between opposing frame members while simultaneously disposing the first hook member on the edge portion of the side wall.

In another aspect of the invention, wall panels placed end-to-end are attached using an upper and lower draw block that engage hanger brackets attached to the ends of the wall panels. A draw rod operably engages the draw blocks which pull the hanger brackets and corresponding panels together.

In yet another aspect of the invention, a corner post is provided for connecting two or more panels at 90°. The corner post includes an elongated tube having a pair of inwardly facing channels formed on each side of the tube. A plate member is secured inside each end of the tube; the upper plate having a threaded hole in the middle of the plate.

The corner post is provided with a height adjustable cap which includes a post member and a cover member supported by the post member. The post member threadably engages the hole in the upper plate and can be rotated to adjust the height of the cover. In this way, the cover can be raised or lowered to provide a smooth transition between adjacent wall panel top caps.

In another aspect of the invention, an outwardly facing groove is formed in each corner of the tube. A cover has diagonally oriented beaded portions. The cover is attached to the corner post by releasably engaging two of the corner grooves with the beaded portions. The post cover is used to cover those sides of the corner post not connected to a wall panel, thereby providing an aesthetically pleasing appearance.

In another aspect of the invention, a method is provided for manufacturing the vertical side frame members. In particular, the method includes providing a core member, a pair of sidewall members each having an edge portion, and a hanger bracket. The hanger bracket is attached to the core member. The core member and attached hanger bracket are then positioned in a fixture such that the hanger bracket engages a first surface of the fixture. The sidewall members are positioned in the fixture on both sides of the core member such that the edge portion of each sidewall member engages a second and third surface of the fixture, respectively, positioned predetermined distances from the first surface. The sidewall members are then attached to the core member.

A similar method is provided for making the upper and lower horizontal frame members, wherein the fixture surfaces are positioned to support the edge portion of the sidewall members and the outer surface of the core member.

A method also is provided for manufacturing the improved wall panel. In particular, one of the sheetlike wall members is placed in a fixture. The side frame members and upper and lower horizontal frame members also are positioned in the fixture. The wall member fills the recess formed by the sidewall members on one side of the rectangular frame. Adhesive is applied to one of the sidewall members and wall member before the frame is disposed on the wall member. Adhesive also is applied to both sides of the filler member. One or more partition members is adhesively attached to the inner surface of the wall member so as to form a vertical channel with the inner surface of one of the side core members. The filler member is inserted into the space formed by the frame members and the partition members. The second sheetlike wall member is then disposed in the recess on the opposite side of the frame. The wall members are attached to each frame member with mechanical fasteners. A decorative sheet and barrier sheet are secured over the outer surface of each wall member.

The present invention provides significant advantages over other wall panel systems and methods of manufacture. In particular, the three-piece frame member construction, i.e., a pair of sidewall members attached to a core member, yields a simple, inexpensive structural part that provides several advantages over roll-formed or extruded metal channels. By using a wood core member, the side wall members can be easily attached to the core with staples, rather than by welding or other more expensive methods of manufacture. Similarly, the wall members can be stapled directly to the frame members, as well as adhesively secured, so as to improve the strength of the panel. In addition, various accessories, such as the power distribution server, can be easily mounted to the bottom of the panel with wood fasteners, without providing mounting holes in the lower frame member. Moreover, the wood can be easily cut to length for each frame member, or shortened so as to provide access to the vertical channel, without wasting material or making complicated cuts or stampings in the sheet metal.

Also important, the three-piece frame member construction allows the manufacturer to provide precise dimensions between the outermost surface of the hanger bracket and the outermost surface of the side wall members. This dimension is critical when two panels are installed adjacent to each other. For example, when two panels are connected, the adjacent hanger brackets are pulled together by a wedge block, as explained below. When connected in this manner, the panel-to-panel interface, or joint between the panels, is defined by the distance between the adjacent outer surfaces of opposing edge portions covered with fabric. Thus, by maintaining the distance between the outer surface of the edge portion and the hanger bracket as a constant, the joints at each panel interface are kept constant, i.e., have the same gap between panels. Moreover, when a wall panel has a thicker fabric installed around the edge portions, the distance between the edge portion and hanger bracket can be increased so that the gap between panels, when connected, remains the same, regardless of the fabric thickness.

The vertical channel also provides significant advantages. For example, wires can be easily routed from the top of the panel to the bottom. The channel also provides ideal passage for the electrical conduit running from the outlet box installed inside the panel. In addition, because the channel is inside of the frame and adjacent to the box, rather than on the outside of the frame, the frame member does not have to be pierced in order to rout the wiring to the outlet box. Moreover, wires disposed in the channel are not exposed when the panels are disconnected and cannot therefore be caught or hooked by the panel-to-panel connectors.

The improved corner post also provides significant advantages over similar devices. For example, the corner post cover is height adjustable, so that it can be adjusted to provide a continuous line across the top of a system of panels. Moreover, the grooves provided in the corner post tube provide a simple but efficient way to attach covers, whether they be flat, or formed at 90°. As such, the orientation of the tube is irrelevant to the placement of connecting panels and/or post covers. Because the tube is symmetrical, the cover and panels can be arranged in any configuration, without having to reorient the tube member.

Yet another significant advantage is the method of fabric attachment. In particular, the double-hook strip configuration allows an installer to use a tool to install the fabric. As such, the installer can apply a considerable force to tightly stretch the fabric between opposing frame members to thereby provide a smooth and pleasing appearance. Moreover, the releasable hook allows the user to easily replace the fabric if it becomes damaged or if a color change is desired. The new fabric can be installed quickly and easily without adhesives or difficult to install elastic bands that run around the periphery of the wall panel. Indeed, adjacent panels need not even by disconnected in order to install a new sheet of fabric, thereby avoiding the task of disassembling the panels.

Finally, the wall panel construction lends itself to improved manufacturability and overall quality. Most importantly, as described above, each frame member can be made with extremely tight tolerances so that the gap between panels is maintained as a constant when the wall panels are assembled as a system. Moreover, by locating the frame members to outside dimensions in the fixture, the overall panel construction is improved by providing extremely tight tolerances for the height and width of each panel. The improved quality associated with this method of manufacture in turn facilitates and eases installation of the panels while providing an improved overall look for the system.

The present invention, together with further objects and advantages, will be best understood by reference to the following detailed description taken in conjunction with the accompanying drawings.

DETAILED DESCRIPTION OF THE PREFERRED EMBODIMENTS

Figure 1:
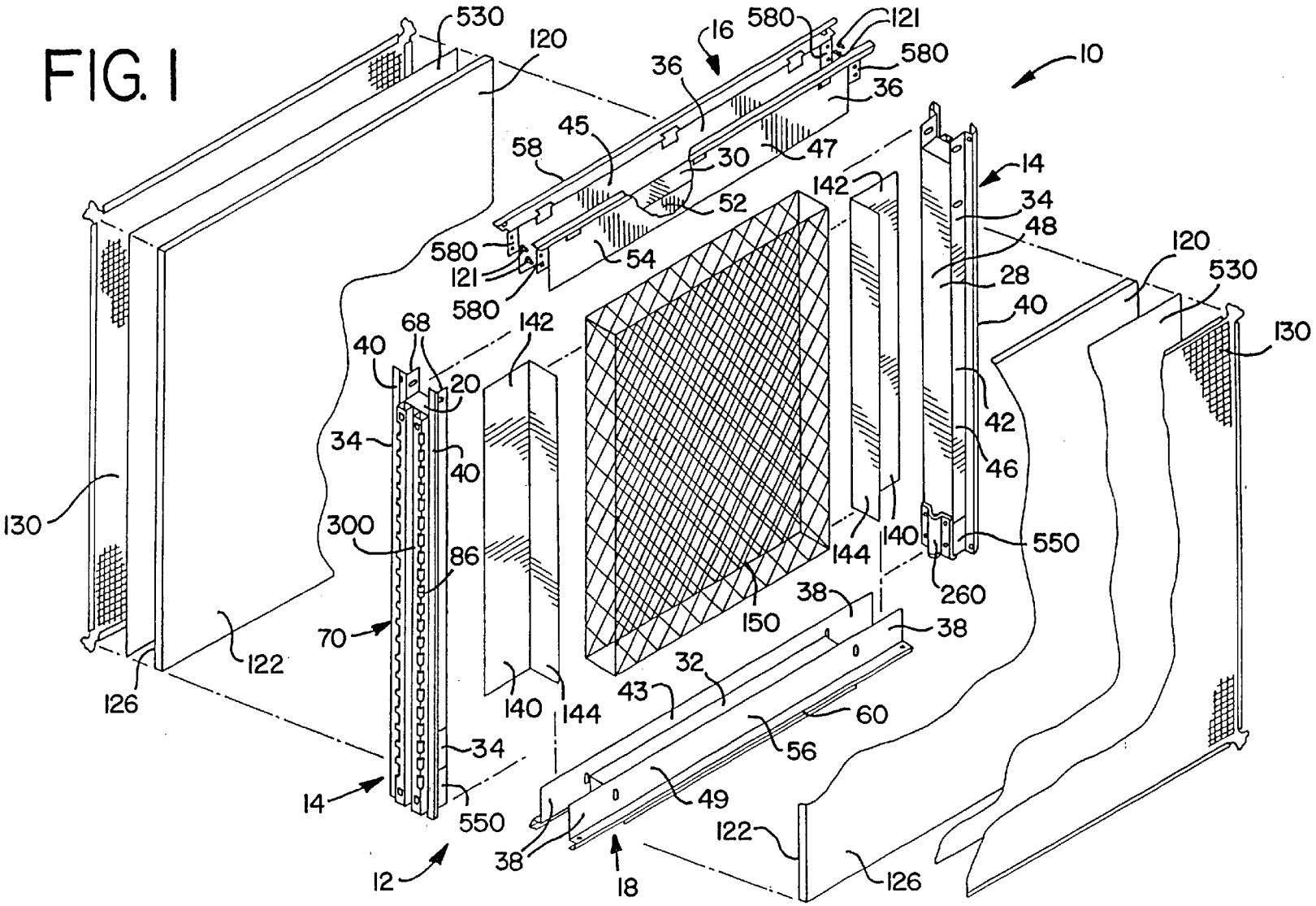
FIG. 1 is an exploded perspective view of the wall panel.

Referring to the drawings, FIG. 1 shows an improved wall panel 10 including a rectangular frame 12, a pair of sheetlike wall members 120 and a pair of thin decorative sheets 130. The frame 12 includes two spaced apart, and generally parallel vertical side frame members 14 and spaced apart and generally parallel horizontal lower and upper frame members 18, 16.

Each frame member 14, 16, 18 includes an elongated core member 28, 30, 32 and a pair of elongated sidewall members 34, 36, 38. Preferably, the core member is made of wood. As used herein, the terms "wood" and "wooden" are intended to have relatively broad meanings, including but not limited to, solid wood and wood products, such as particle board, fiber board and laminated strand lumber. Most preferably, the side core members 28 are made of laminated strand lumber, such as the 38# density material available from TrusJoist/MacMillan Ltd. Partnership in Deerwood, Minnesota. The horizontal core members 30, 32 preferably are made of 45# density particle board. Alternatively, other materials, such as foamed polymers or composites, may be used.

Figure 16:
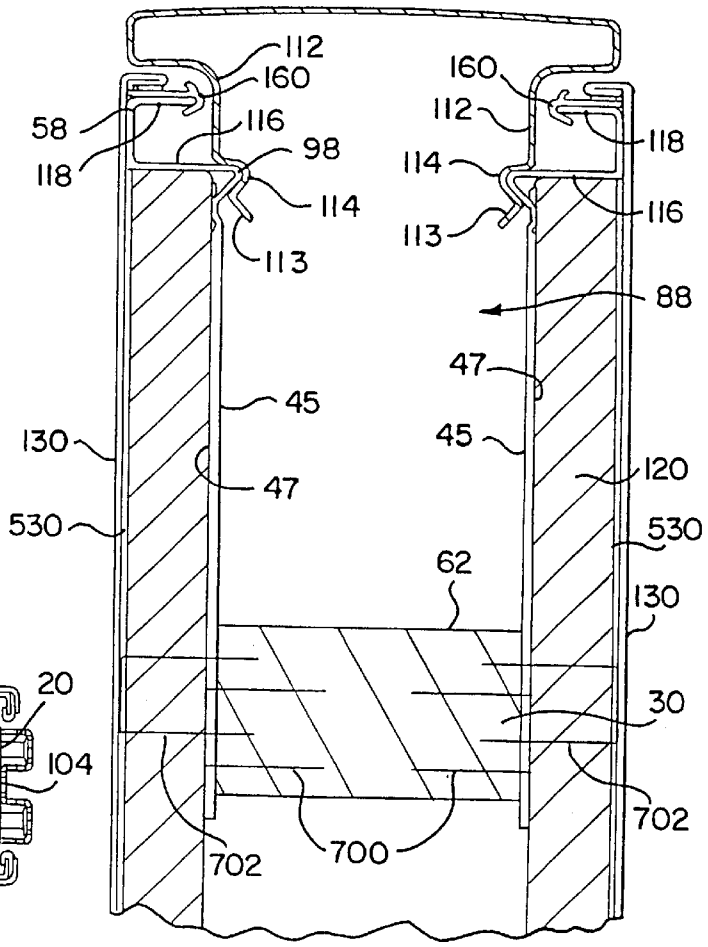
FIG. 16 is a cross-sectional view of the wall panel taken along line 16—16 of FIG. 8.

Each sidewall member 34, 36, 38 includes a substantially flat leg portion 42, 54, 56 and edge portion 40, 58, 60 respectively. The edge portion 40, 58, 60 extends laterally outward from the leg portion 42, 54, 56. Preferably, the sidewall members are made from 12 gauge steel sheet metal and are roll formed. However, it should be understood that other materials, such as plastic could also be used. Each leg portion has an inner 44, 45, 43 and outer surface 46, 47, 49; the inner surface 44, 45, 43 engages the side surface of the core member. Preferably, the inner surface 44, 45, 43 is mechanically fastened to the side 52, 53, 57 of the core member, for example, by using staples 700, as shown in FIG. 16. Alternatively, adhesive, nails, rivets or screws can be used to secure the sidewall member to the core member.

Figure 2:
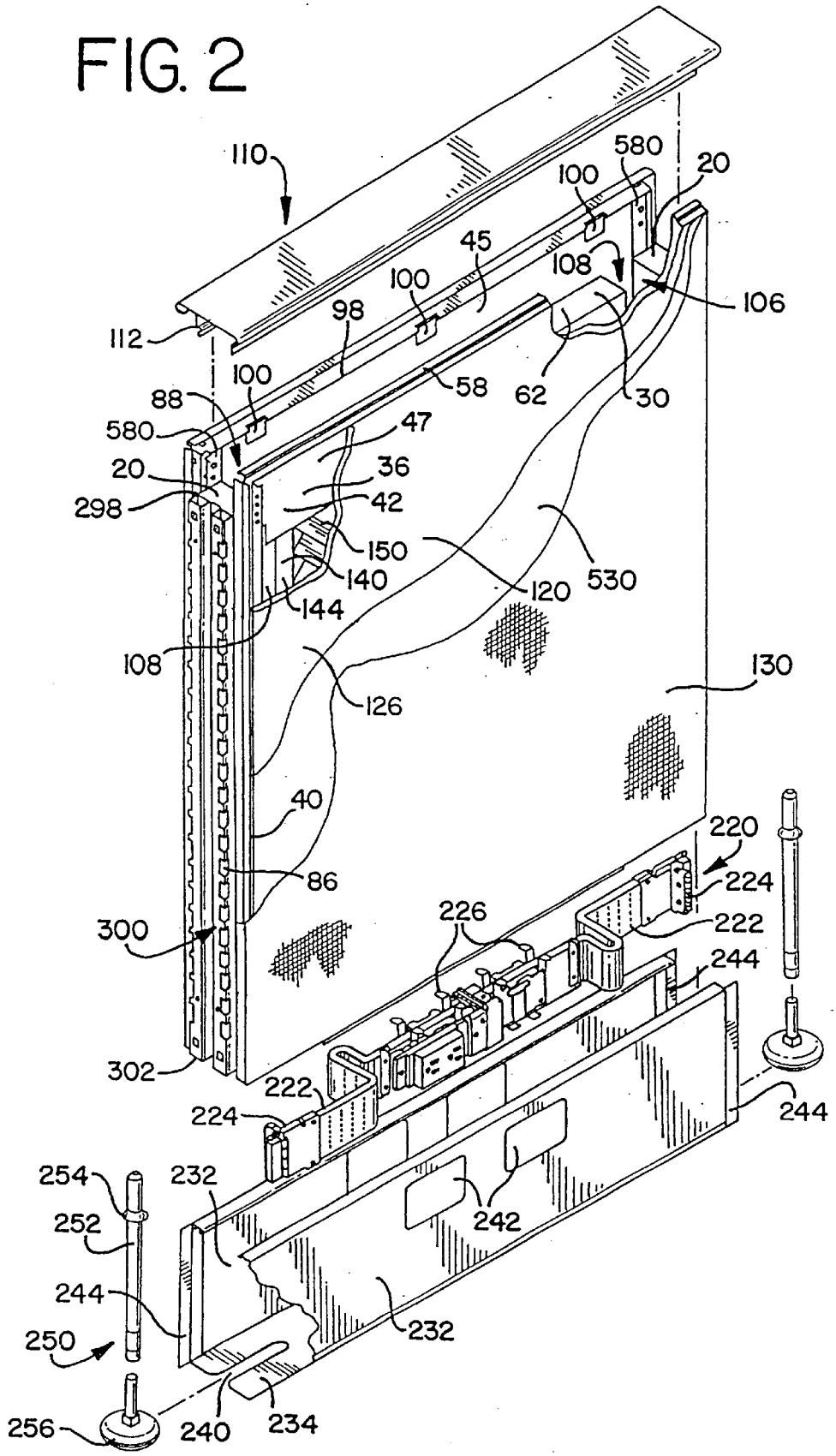
FIG. 2 is an exploded perspective view of the wall panel with a top cap, base cover and power distribution system.

As shown in FIG. 1, the sidewall members 34 of each vertical frame member include an end portion 68 that extends upwardly past the top end 20 of the side core member 28 along the longitudinal direction of the vertical frame member 14. The upwardly extending end portions 68 of the sidewall members 34 overlap the sidewall members 36 of the upper frame member 18, which include leg portions 54 that extend upwardly from the upper frame core member 30. Each end of the upper frame member sidewall members 36 includes a flange portion 580 stepped inwardly from the leg portion 54, as shown in FIGS. 1 and 2. The flange portion 580 extends from and is integrally formed with the leg portion. The upwardly extending end portions 68 overlap and are attached to the corresponding stepped flange portions 580 and the wall member 120, preferably with mechanical fasteners. Because the flanged portion 580 is stepped inwardly, the outer surfaces 46, 49 are flush. The edge portion 58 of the upper frame member and the edge portion 40 of the vertical frame are mitered at approximately 45° at the point of intersection in order to form a corner.

As shown in FIGS. 1, 2, 9 and 10, an elongated hanger bracket 70 is mounted to the outer surface 50 of each vertical core member. The hanger bracket 70 includes two spaced apart, inwardly facing channels 72 connected by a bridge portion 74 that is fastened to the core 28, preferably with a plurality of fasteners 540. Fasteners 542 also secure each end of each channel 72 to the core member 28. Each channel 72 has an inner leg 76, an outer leg 78 and an outer surface member 82. The inner legs 76 of the channels and the bridge portion 74 form an outwardly facing channel 300. The outermost corners 84 on each bracket, formed by the intersection of the outer leg and the surface member, have a plurality of slots 86 running the length of the hanger bracket. The outer surface member 82 of the inwardly facing channels 72 defines the outermost surface of each end of the wall panel. The slots 86 in the hanger bracket are adapted to receive and support various components attached to the wall panel. For example, overhead units and worksurface bracket supports, not shown in the Figures, typically engage the wall panel at the slots. For example, a cantilever bracket assembly adapted to engage the hanger bracket is described in U.S. Provisional Application Ser. No. 60/019,285, entitled CANTILEVER BRACKET ASSEMBLY and filed Jun. 7, 1996, the disclosure of which is hereby incorporated by reference.

As shown in FIGS. 2, 8, 9 and 44, the inner surface 43 of the upwardly extending sidewalls 36 on the upper frame member and the outer surface 62 of the upper core member 30 form a horizontal channel 88 which runs the width of the panel. At each end of the wall panel, the upper end 20 of the vertical side core member 28 lies substantially flush with, or slightly higher than, the outer surface 62 of the upper core member 30 so that wires, cables and the like can be passed easily from one panel to the next. In this way, the upper end 20 of the vertical core member 28 helps to define a portion of the bottom of the horizontal channel 88.

Figure 43:
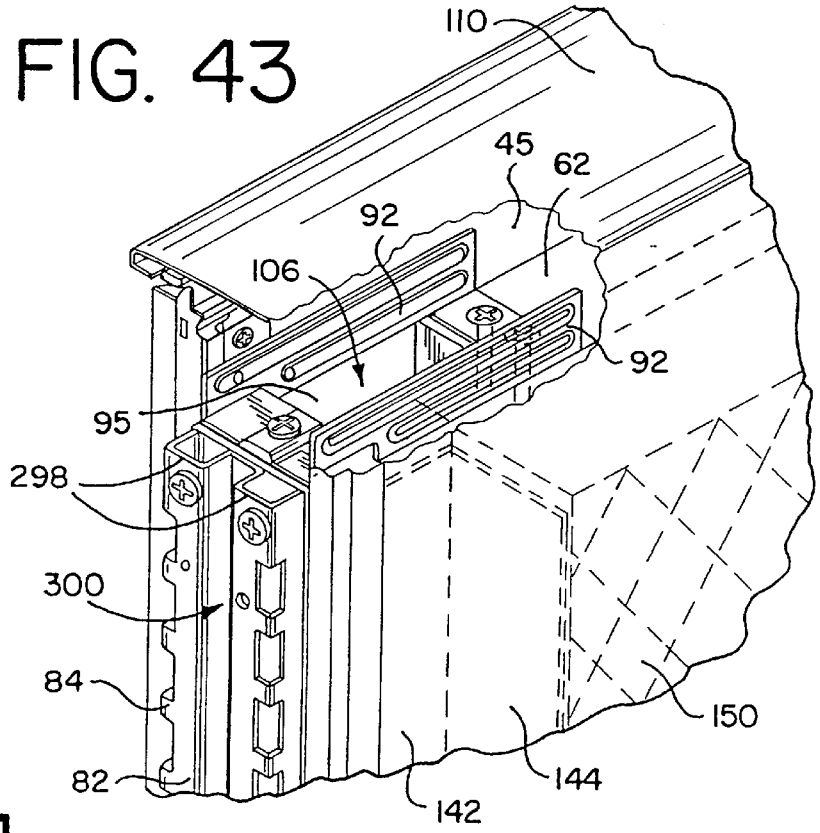
FIG. 43 is a perspective view of a brace member installed on a wall panel.
Figure 44:
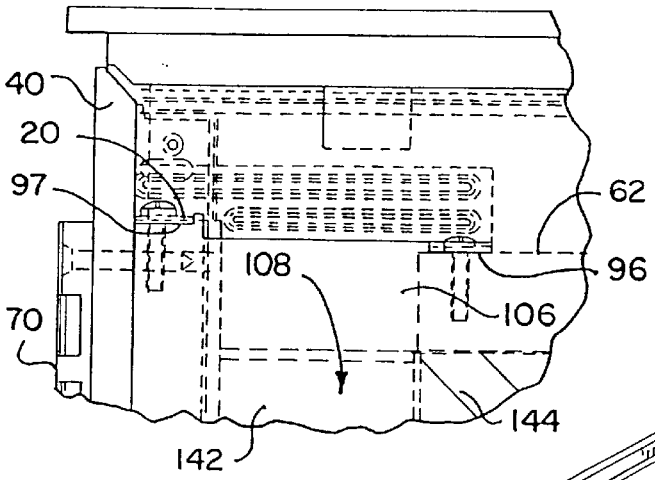
FIG. 44 is a side view of a brace member installed on a wall panel.
Figure 45:
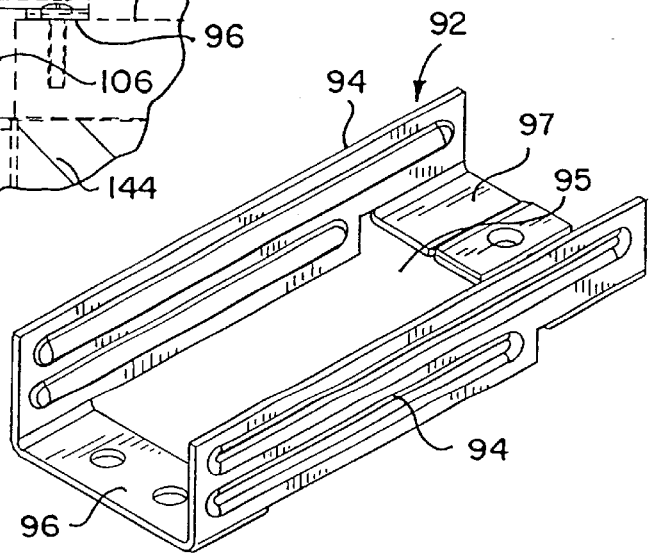
FIG. 45 is a perspective view of a brace member.

As shown in FIGS. 43–45, a brace member 92 can be mounted at each end of the channel to provide additional support for the panel. The brace member 92 includes a pair of sidewall members 94 disposed along the inner surface 45 of the sidewall members. The brace member 92 also includes a bottom plate 97 attached to the end 20 of the core member and a second bottom plate 96 attached to the outer surface 62 of the upper core member 30. It should be understood that the sidewall members can also be attached to the wall members. An opening 95 is provided between the plates to provide access to a vertical channel 108. The brace member 92 provides additional support for loads applied laterally to the top or side of the panel. In particular, the brace member helps distribute the load between opposing wall members, the upper frame member and the vertical frame member.

Figure 18:
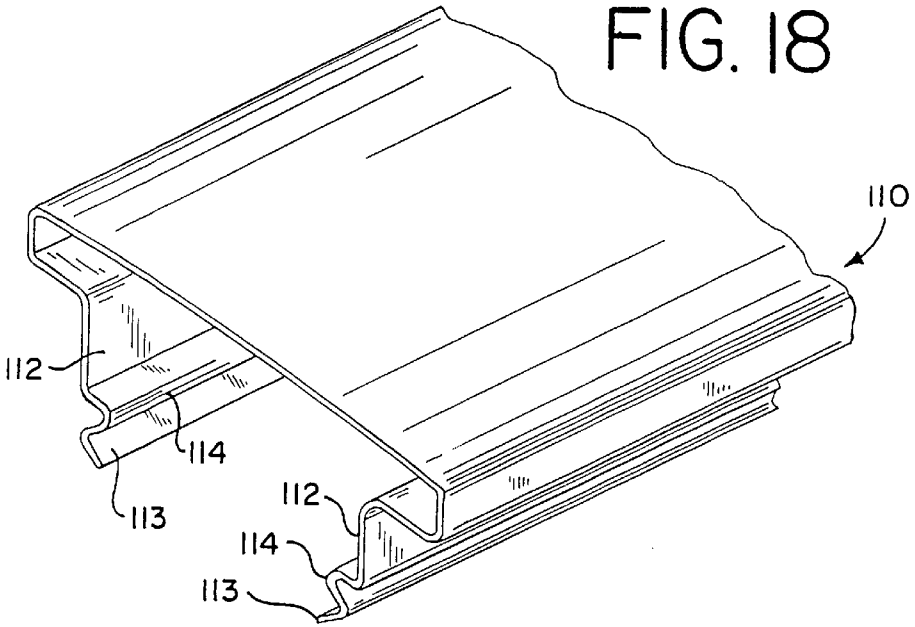
FIG. 18 is a partial perspective view of the top cap.

As shown in FIGS. 2, 16 and 18, the top portion of each sidewall leg portion on the upper frame members includes an inwardly facing ridge 98 that runs substantially the length of the upper frame member 18. Intermittent openings 100 are provided along the top portion. The openings are provided to locate the sidewalls in various tool fixtures during the assembly of the frames and wall panel.

A top cap 110 is attached to the upper frame member 18. The top cap 110 includes a pair of downwardly facing flanges 112 that have a ribbed portion 114 running the length of the flanges. The ribbed portion 114 engages the ridge 98 formed on the inside of each sidewall member and releasably secures the top cap to the upper frame member. Each of the flanges 112 also includes an edge portion 113 that is angled inwardly from the ribbed portion 114. The edge portion 113 facilitates installation of the top cap by engaging the ridges on the upper frame member as the top cap is first inserted into the channel 88. As the top cap 110 is pushed downwardly, the edge portions 113 slide along the ridge so that the flanges are biased inwardly until the ribbed portion engages the ribbed portion 114. The flanges 112 then spring back to their original position, as the ribbed portion releasably locks the top cap to the upper frame member. In this way, the top cap 110 covers and encloses the channel 88.

Figure 17:
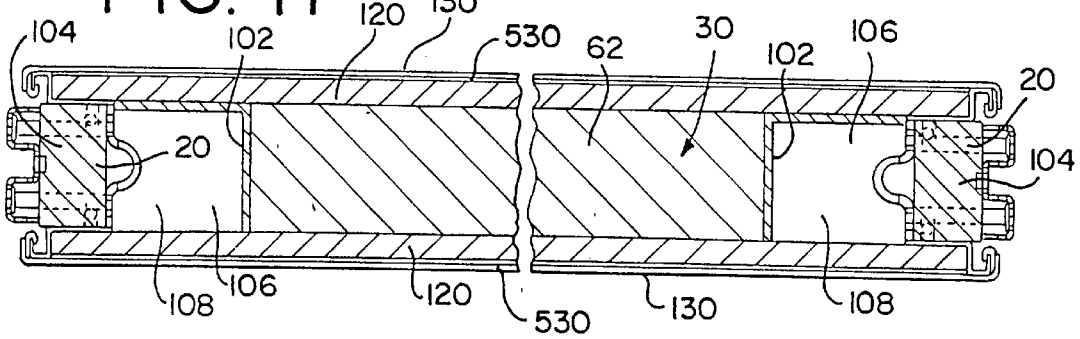
FIG. 17 is a cross-sectional view of the wall panel taken along line 17—17 of FIG. 8.

In a preferred embodiment, the ends 102 of the upper core member are spaced apart from the ends 104 of the vertical core member to form an opening 106 between the members near each end of the panel as shown in FIG. 17. These openings 106 provide access to a vertical channel 108, or tube, that extends between the upper horizontal channel 88 and the bottom of the wall panel, as shown in FIGS. 2, 8, 10, and 11. Each vertical channel 108 is formed and defined by the inner surface 48 of the vertical core member, a partition member 140 that extends between the upper and lower horizontal frame members 16, 18 and the inner surface 122 of the wall member 120.

Figure 12:
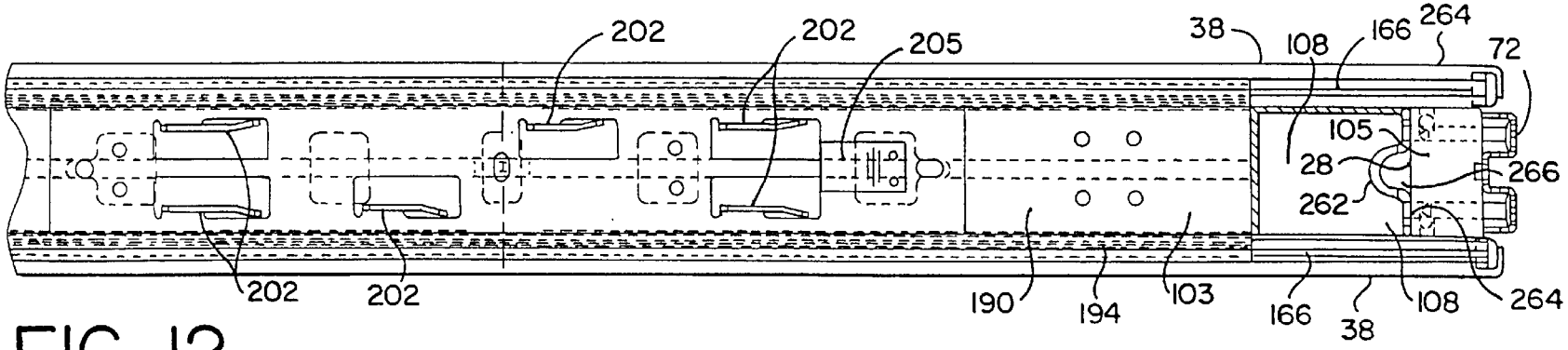
FIG. 12 is a bottom view of the wall panel taken along line 12—12 of FIG. 8, with the power distribution server omitted.

The ends 103 of the lower horizontal core member are spaced apart from the lower end 105 of the vertical core members so as to provide access to the vertical channel 108 from the bottom of the panel as shown in FIG. 12. In addition, the sidewall members 38 on the lower frame member extend outwardly past the end 103 of the core member along the longitudinal direction of the frame member, as shown in FIG. 1. The sidewalls 34 are cut away at the lower end 105 of the vertical side core member to provide an exposed portion 550 of the side core member. The outwardly extending bottom sidewall members 38 overlap the exposed portion, and lie flush with the side frame sidewalls 34. The edge portions 60, 40 intersect and are mitered at approximately 45° to form a corner. The lower core member 32 also includes a groove 33 running the length of the core member along the middle of the outer surface 66.

Figure 10:
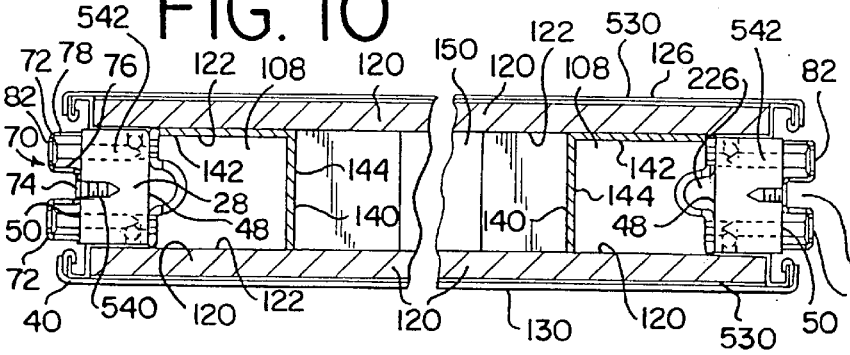
FIG. 10 is a cross-sectional view of the wall panel taken along line 10—10 of FIG. 8.
Figure 14:
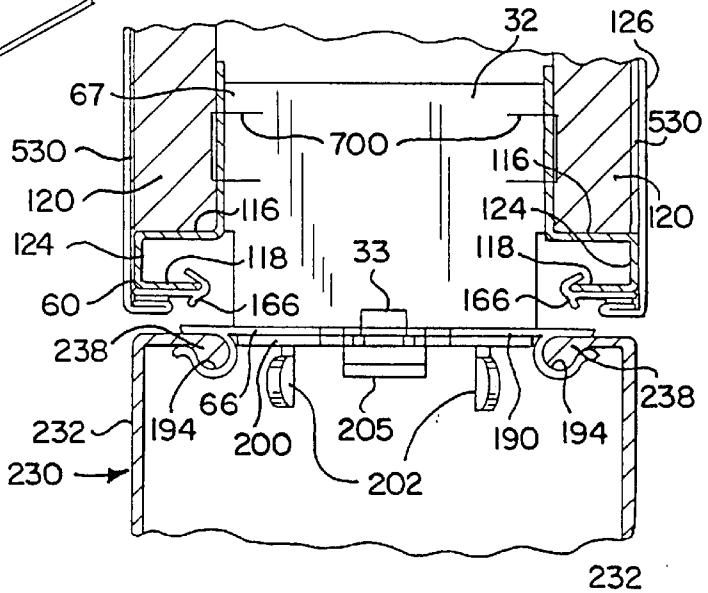
FIG. 14 is a cross-sectional view of the wall panel taken along line 14—14 of FIG. 8 with the power distribution server not shown.
Figure 15:
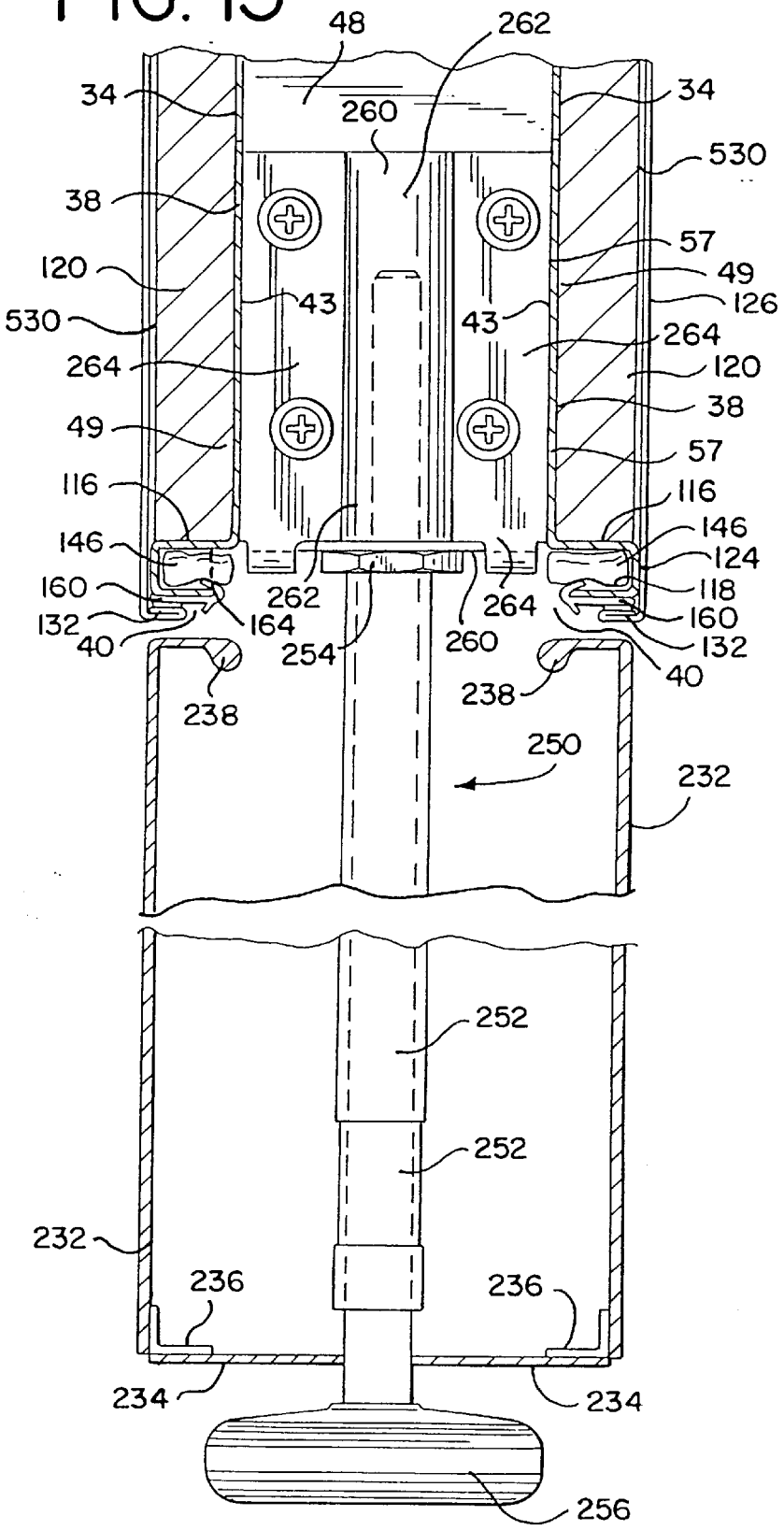
FIG. 15 is a cross-sectional view of the wall panel taken along line 15—15 of FIG. 8.

As shown in FIG. 10, 14 and 16, the edge portions 40, 58, 60 of each sidewall member are preferably configured as a C-shaped channel that runs the length of each side wall member. When the frame members are connected, the edge portions 40, 58, 60 run substantially around the entire periphery on each side of the panel. Each channel includes an inner leg 116 that extends laterally outward in a perpendicular relationship from the leg portion and an outer leg 118 that defines the outer peripheral edge of the wall panel. A intermediate surface member 124 connects the inner 116 and outer leg 118. The surface member 124 is in substantially the same plane as the outer surface 126 of the wall member as shown in FIGS. 14–16. The inner leg 116 of the edge portion and the outer surface 46, 47, 49 of the sidewall leg portions 42, 54, 56 define a shallow, outwardly facing recess on each side of the frame. The recess is shaped to receive the sheetlike wall member 120. Preferably, the wall member 120 substantially fills the recess and is bounded around its periphery by the inner legs 116 of the side walls.

As just described, each wall member is attached to one side of the frame with staples 702, as shown in FIG. 16. The wall members stabilize and strengthen the wall panel. Preferably, the wall member 120 is made of ½ inch thick fiberboard, such as the industrial insulation board available from Masonite in Lisbon Falls, Me., which is sanded, ironed and sealed. Preferably, the wall member 120 is tackable, so that a user can attach various items to the wall member with tacks, or the like. Other materials, such as particle board or mineral board are also acceptable. Preferably, the wall member 120 is both adhesively secured to the outer surface 46, 47, 49 of the sidewalls and is mechanically fastened to the core members 34, 36, 38 through the sidewall members, preferably by stapling. The overlapping portions of the sidewall members 34, 36 of the vertical frame and the upper frame members are mechanically fastened to each other and to the wall member 120 from the inside out, preferably with screws 121 as described above and shown in FIGS. 1, 2 and 8.

As shown in FIGS. 1, 8 and 10–11, a filler member 150 is installed inside the rectangular frame 12. The filler member 150 is disposed between the wall members 120 and each side of the frame, and extends between the upper and lower horizontal frame members 16, 18. In a preferred embodiment, the filler member 150 is a honeycomb structure made from corrugated cardboard. The honeycomb is adhesively secured to the inner surface 122 of each wall member. The honeycomb increases the strength of the panel and provides sound dampening for the panel. Preferably, the honeycomb filler member is bounded along each vertical end by the partition members 140 installed to form the vertical channels 108. In this way, the vertical channels are separated from the honeycomb filler member.

Figure 11:
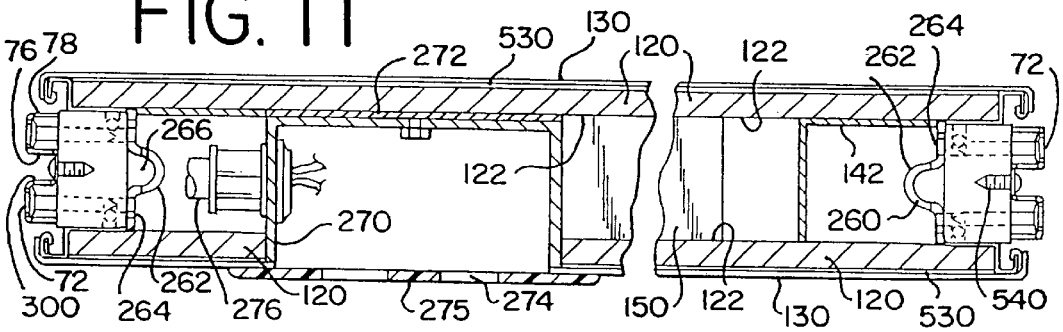
FIG. 11 is a cross-sectional view of the wall panel taken along line 11—11 of FIG. 8.

The partition member 140 includes a mounting flange 142 and a boundary flange 144 as shown in FIG. 1. Referring to FIGS. 10 and 11, the mounting flange 142 is adhesively bonded to the inner surface 122 of one of the wall members 120. The boundary flange 144 extends between the two wall members 120 and can be attached to the side of the honeycomb filler member.

Referring to FIGS. 1 and 2, a thin barrier sheet 530, or scrim, is disposed between the decorative sheet 130 and the wall member 120. The barrier sheet 530 preferably includes a layer of aluminum foil laminated to a thin layer of fiberglass. The barrier sheet 530 is preferably about 0.005 inches thick and is used as a fire blocking material. A commercially available barrier sheet is the MANNIGLAS 1207® wet-lay glass fiber mat produced by Lydall Corporation. The barrier sheet can be attached to the wall member with adhesive or mechanical fasteners. Alternatively, the barrier sheet can wrap around the outer leg of the edge portion beneath the decorative sheet, which is attached to the leg with a strip member as described below.

Referring to FIGS. 1 and 2, each thin decorative sheet 130 is disposed over one of the outer surfaces 126 of the wall members. The decorative sheet is preferably a cloth fabric, although it should be understood that other flexible materials would be suitable for covering the wall panel. Referring to FIGS. 10, 14, 15 and 16, the sheet is wrapped around the edge portion 40, 58, 60 of each sidewall member and is attached to the outer leg 118 of the edge portion. Preferably, a strip 160 is attached to each edge 132 of the sheet. The strip may be sewn to the sheet or adhesively bonded. For example, as shown in FIGS. 21–23, the strip is attached with a double-sided tape 162 and sewn to the sheet.

Figure 21:
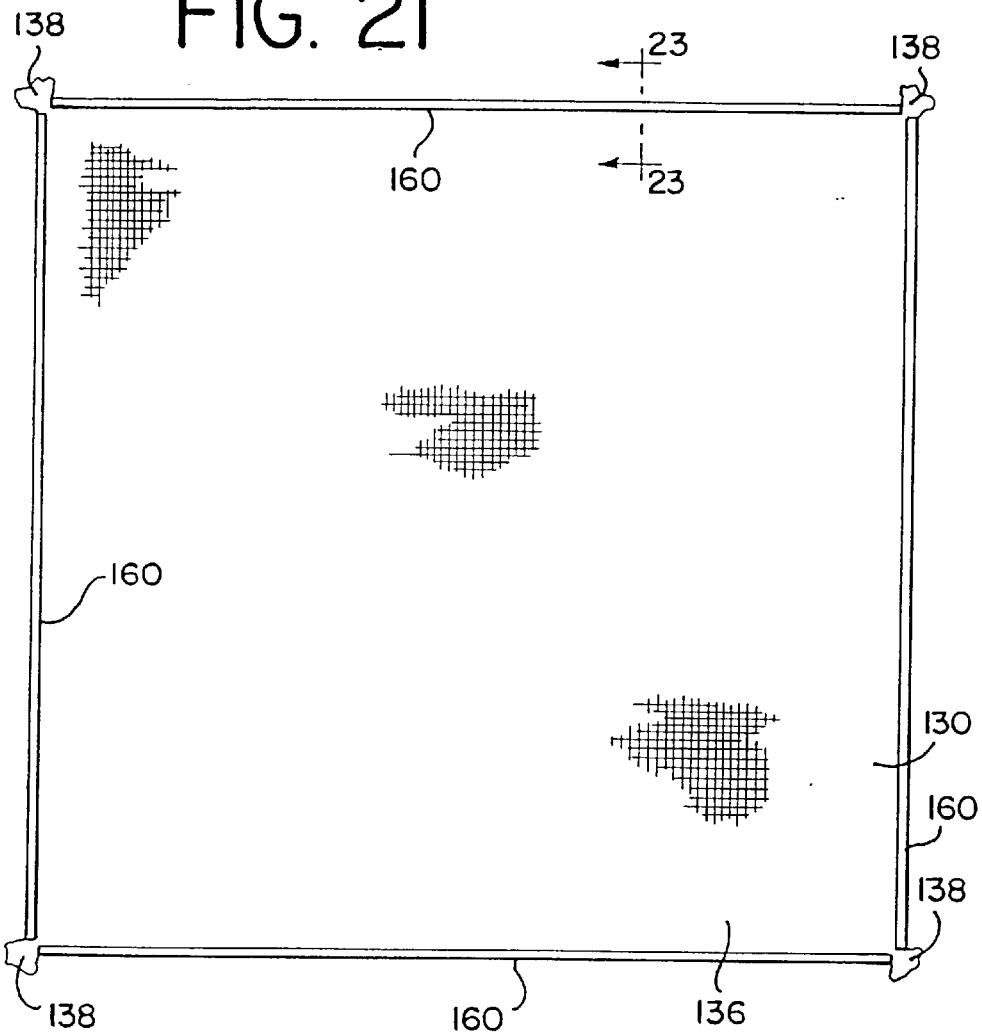
FIG. 21 is a side view of the fabric sheet.
Figure 22:
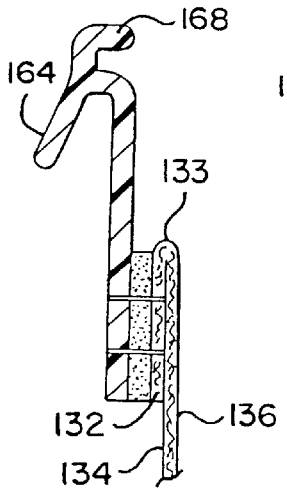
FIG. 22 is a cross-section of the strip attached to the fabric.
Figure 23:
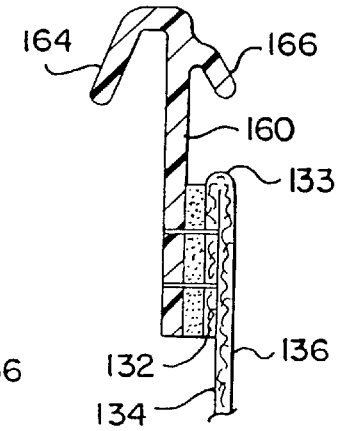
FIG. 23 is a cross-section of an alternative embodiment of the strip attached to the fabric.

Referring to FIGS. 21 and 23, the strip 160, preferably made from plastic, includes a first hook member 164 adapted to engage the outer leg 118. The strip 160 is attached to the outer surface 136 of the fabric sheet 130 so that the first hook member 164 faces outwardly towards the edge of the fabric. Before installing the fabric, however, the fabric is folded over as shown in FIGS. 22–23 so that the strip 160 is positioned along the inner surface 134 of the fabric and so that the first hook 164 faces inwardly away from the folded edge 133 of the fabric. The first hook member 164 is disposed on the outer leg 118 of the edge portion of the sidewall member as shown in FIGS. 14–16.

Figure 24:
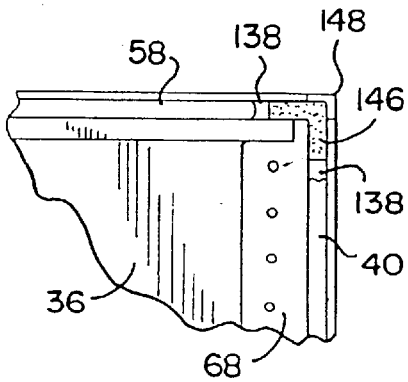
FIG. 24 is a side view of the inside corner of the upper horizontal channel.

Excess portions of the decorative sheet, or fabric, extend outwardly from each corner of the fabric sheet between the ends of the adjacent strip members to form a corner patch 138 of material as shown in FIG. 21. The corner patch 138 is tucked inside the eight corners formed by the edge portion channels 40, 58, 60 of the vertical, upper and lower frame members as the first hook member is installed on the outer leg of each channel. As shown in FIG. 24, a flexible corner block 146 is inserted into intersecting channels 40, 58 at one of the upper corners to hold the excess fabric, or corner patch 138, in the channels. Preferably, the corner block 146 is made of foam, although other resilient and flexible materials, such as rubber, may also be used. By tucking the excess fabric, or corner patch 138, into the channels 40, 58, the exterior, exposed corner 148 of the wall panel is covered and provided with an aesthetically pleasing appearance.

In a preferred embodiment, the strip 160 also includes a second hook member 166. In one embodiment, shown in FIG. 23, the second hook member 166 is positioned opposite of the first hook 164 and faces the same direction as the first hook member, i.e., opens inwardly away from the folded edge 133 of the fabric when it is folded over on itself. In a second embodiment, shown in FIG. 22, the second hook 168 is positioned at the end of the strip and opens outwardly away from the outer surface 136 of the fabric. In either embodiment, the second hook member 166, 168 is adapted to allow an installer to stretch tightly the fabric 130 while installing the first hook 164 on the outer leg 118 of the sidewall member.

Figure 46:
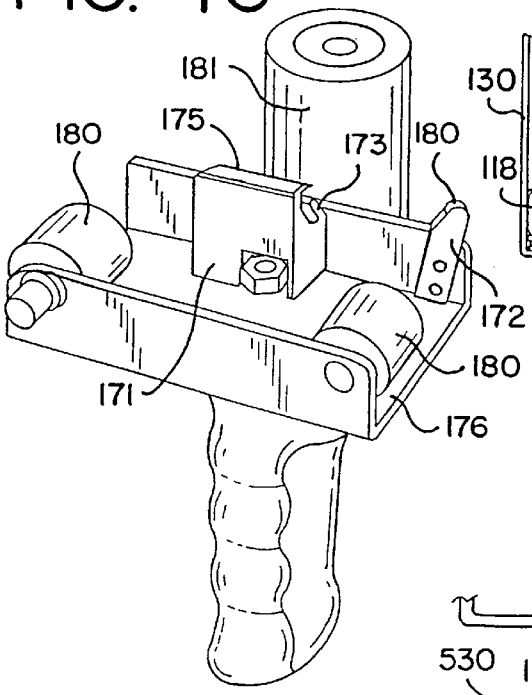
FIG. 46 is a perspective view of a fabric installation tool.
Figure 47:
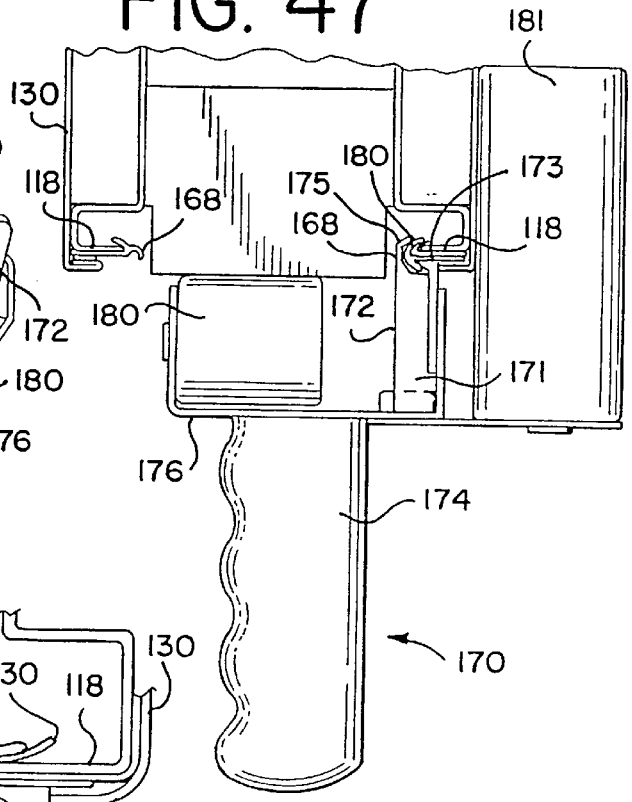
FIG. 47 is a top view of the fabric installation tool engaging a fabric sheet on a wall panel.

To facilitate the installation of the fabric 130, a tool 170 is provided. The tool 170 includes a mounting block 171, a blade 172, a handle 174 and a housing 176 as shown in FIGS. 46–47. The mounting block 171 is mounted to the housing and includes a lip portion 173 adapted to engage the second hook 168, and a guide member 175 configured as a hook that is adapted to be disposed around the end of the strip and first hook 164. The tool also includes a plurality of wheels 180, 181 rotatably mounted to the housing 176 and adapted to rotatably engage the side of the wall panel as the tool is moved around the periphery of the panel while engaging the strip 160.

To install the sheet of fabric, at least one edge 132 is installed by disposing the first hook 164 on one of the sidewall member outer legs 118 as shown in FIG. 14–16. The installer then engages the fabric with the tool by inserting the lip portion 173 in one of the second hooks 166, 168 on one of the remaining strips, as shown in FIG. 47, and moves the tool along the edge of the wall panel. As the tool moves along the edge of the panel, the lip portion 173, which is inserted into the second hook 168 as the guide member 175 encircles the end of the strip, pulls the strip inwardly so that the first hook 164 can be inserted onto the outer leg 118 as the end of the strip and first hook passes through the space between the core member, or hanger bracket, and the free edge of the outer leg 118. The blade 172 includes an edge 180 that is adapted to engage the strip and force the hook member past the outer leg. Thus, the installer uses the tool 170 to stretch the fabric 130 and force the first hook 164 of the strip past the end portion and dispose it on the outer leg 118. It should be understood that various tool configurations would work equally well for stretching and mounting the fabric sheet.

Figure 47A:
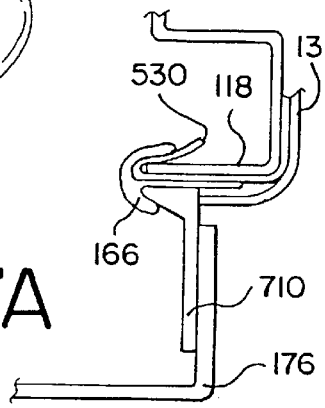
FIG. 47A is an partial enlarged view of an installation tool with an alternative b e configuration.

In another embodiment, the tool includes a second blade member 710 having an edge 602, as shown in FIG. 47A. The blade member 710 is adapted to engage the second hook and install the first hook on the sidewall as described above with the lip portion. As shown in FIG. 47A, the barrier sheet 530 is wrapped around the outer leg 118 and secured to the sidewall beneath the first hook.

Figure 48:
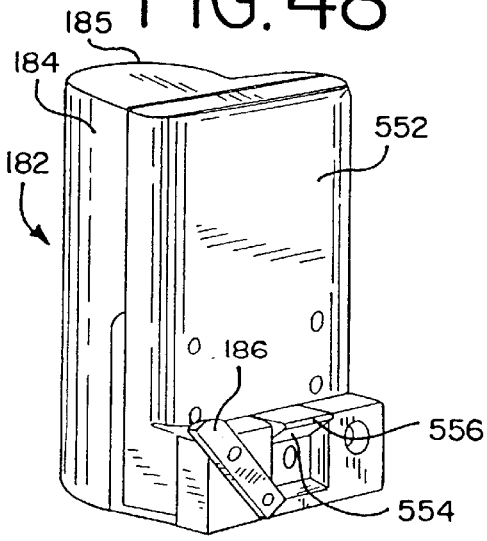
FIG. 48 is a perspective view of an alternative embodiment of the fabric installation tool.
Figure 49:
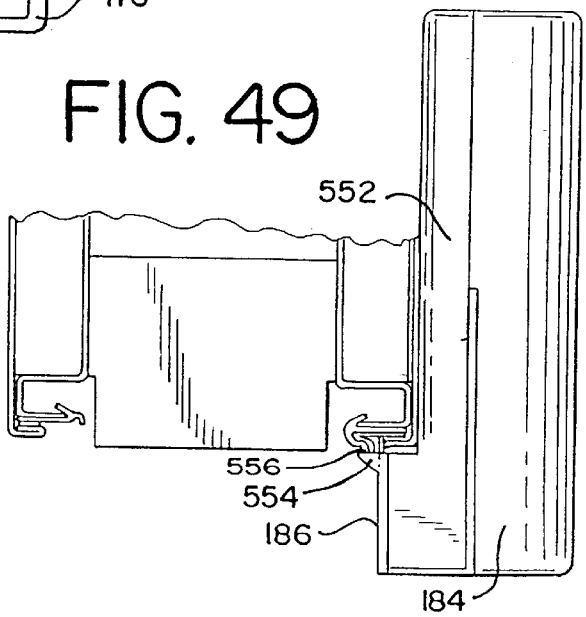
FIG. 49 is a top view of the fabric installation tool of FIG. 44 engaging a fabric sheet on a wall panel.

As shown in FIGS. 48–49, yet another embodiment of the tool 182 includes a handle member 184 having a curvilinear surface grip 185, a surface member 552, a mounting block 554 having a lip portion 556 and a blade 186. As just described, the lip portion engages the second hook, while the blade pushes the strip, and first hook, against the outer leg 118. The surface member is preferably made of plastic, such as Delrin, so that it slides easily along the edge of the panel without damaging or tearing the fabric. This embodiment could also employ a second blade member as just described. It should also be understood that alternative embodiments, such as a simple putty knife, also can be used to engage the second hook, stretch the fabric and dispose the first hook on the outer leg of the edge portion.

The strip and hook arrangement disclosed herein is ideally suited for attaching fabric to a wall panel. For example, if the fabric were to become stained, worn or torn, an installer can remove the fabric quickly and easily by using a tool in the opposite manner as described above to disengage the first hook from the outer leg on the sidewall member. Moreover, the fabric can be removed while the panel is connected to adjacent panels if using a tool that can be inserted into the gap between the panels to engage the second hook member. This provides significant advantages over the prior art fabric attachments, which were either permanently secured to the panel or were retained by an elastic band running around the periphery of the panel. In either configuration, the panel had to be disconnected from the adjacent panels so as to access and remove the band or to remove the adhesive.

It should also be understood by one skilled in the art that the strip and hook fabric attachment device can also be used to secure fabric to objects besides wall panels, such as chairs, cabinets, etc. All that is needed is an edge on which to secure the hook member. Thus, the attachment of the fabric to the wall panel as described above is meant to be illustrative rather than limiting.

Figure 58:
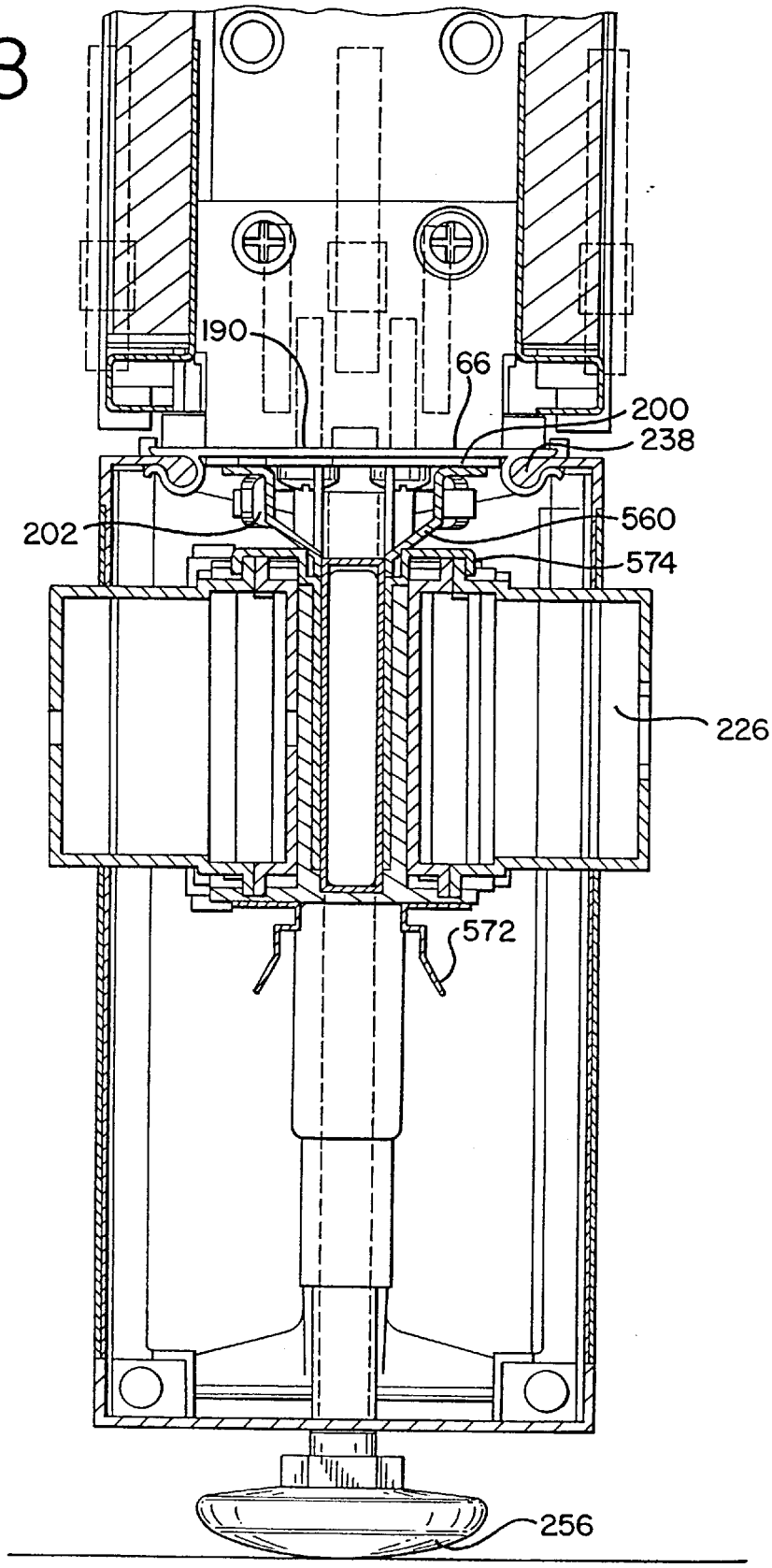
FIG. 58 is an end view of a wall panel with a power distribution server attached to the bottom of the wall panel as taken along line 58—58 of FIG. 31.

The lower horizontal frame member, shown in FIGS. 12, 14 and 58, includes a mounting strip 190 and a bracket 200 mounted to the outer surface 66 of the lower core member. As shown in FIG. 14, the outer surface 66 preferably extends below the end portions of the sidewalls. The side surface 67 of the portion of the lower core member extending below the leg portion of the sidewall member is stepped inward to permit the hook member on the strip to be installed on the outer leg. The groove 33 runs along the outer surface of the core member.

Figure 13:
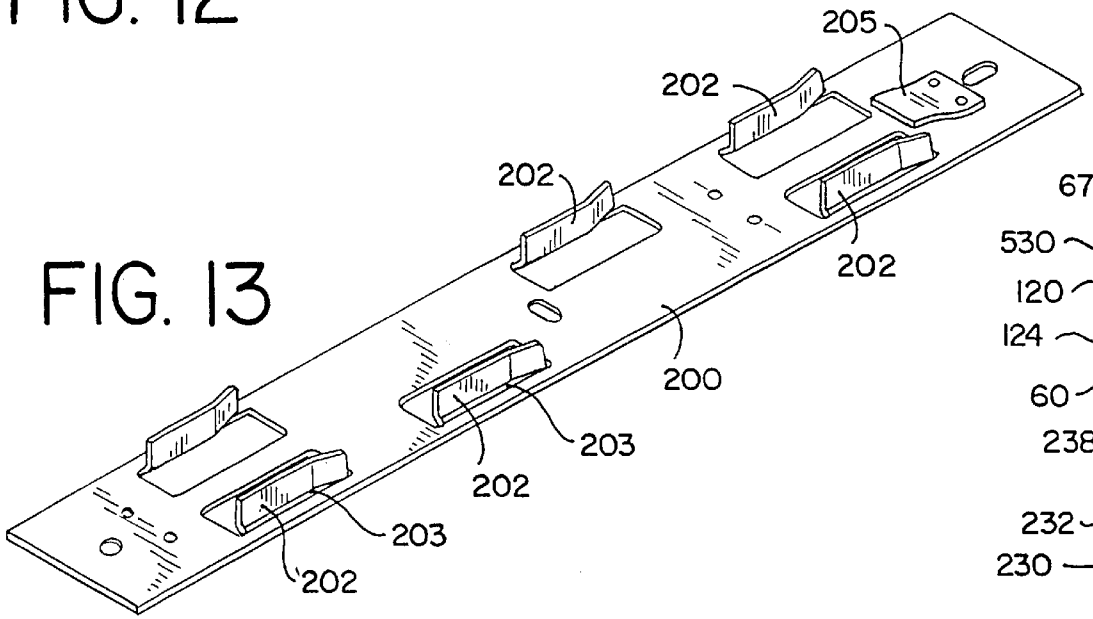
FIG. 13 is a perspective view of the power distribution bracket.
Figure 59:
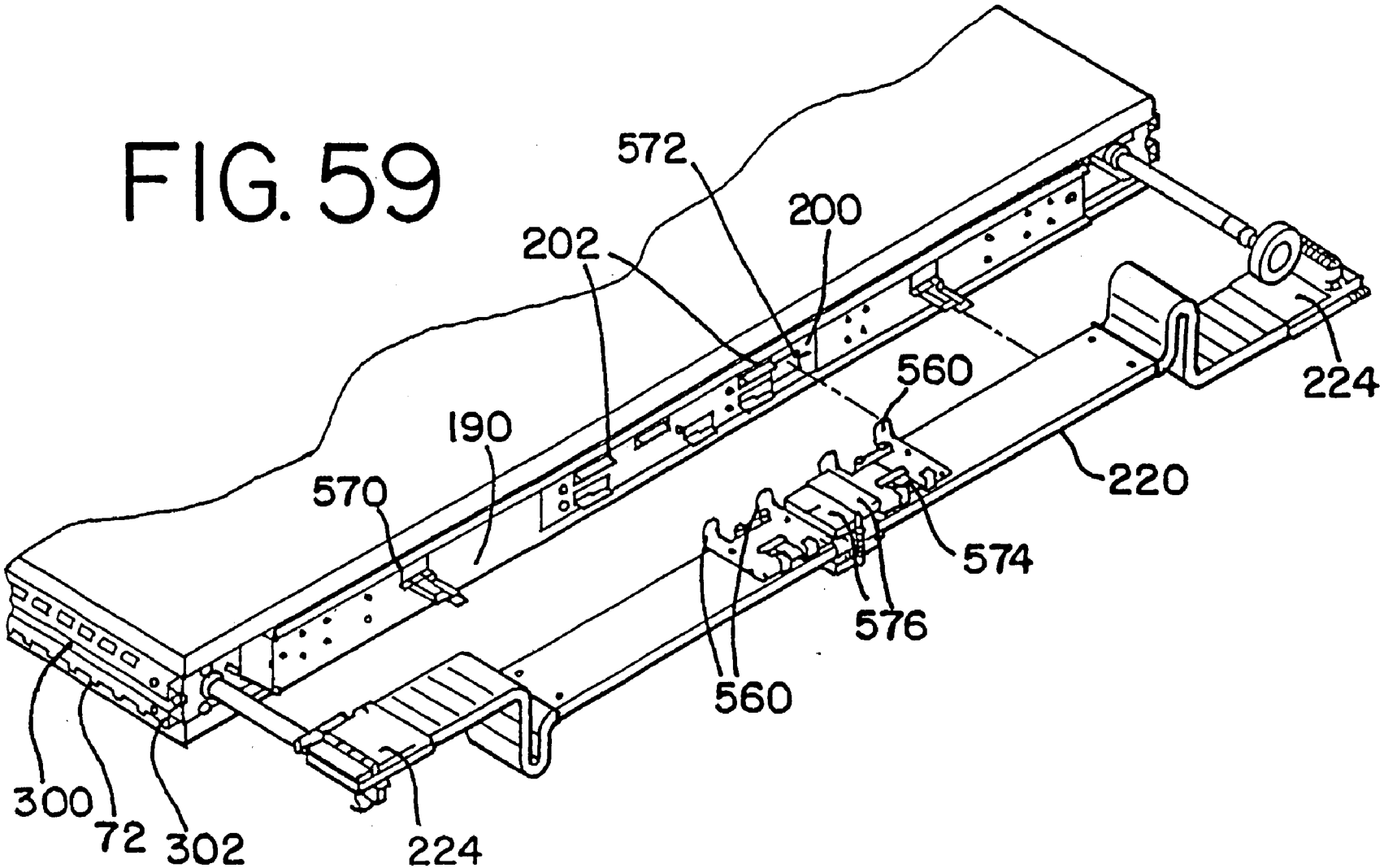
FIG. 59 is a bottom perspective exploded view of a wall panel and power distribution server.

The bracket 200 includes several tab members 202 which are adapted to engage and support a power distribution server 220, including an electrical power harnesses 222, as shown in FIGS. 2 and 59. Referring to FIGS. 12 and 13, the tab members 202 form slots 203 that receive bracket hooks 560 extending upwardly from the power distribution server as shown in FIG. 59. In operation, the harness 222 is installed by sliding the bracket hooks 560 into the slots 203 until the end of the bracket 560 passes a resilient locking tab 578 which springs downwardly to releasably secure the harness 222 on the bracket 200. When the wall panel is particularly long, the bracket may also include stabilizer brackets 570 that extend downwardly from the bracket and include two arms that engage the harness.

Figure 25:
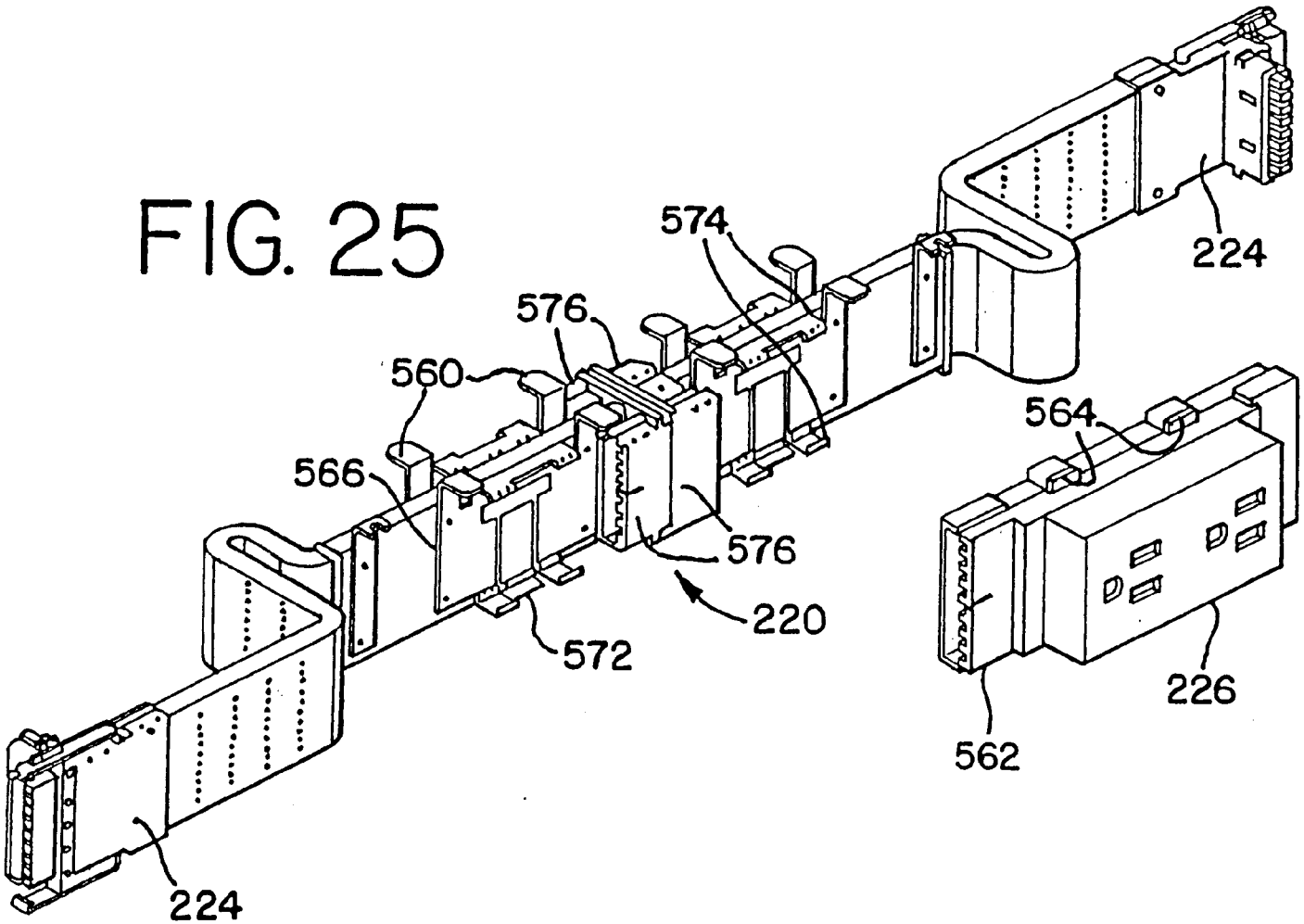
FIG. 25 is a perspective view of the power distribution server.
Figure 27:
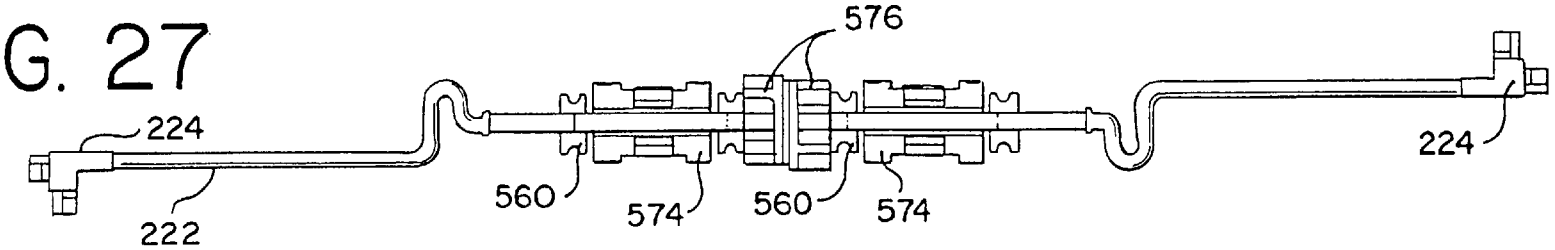
FIG. 27 is a top view of the power distribution server.
Figure 26C:
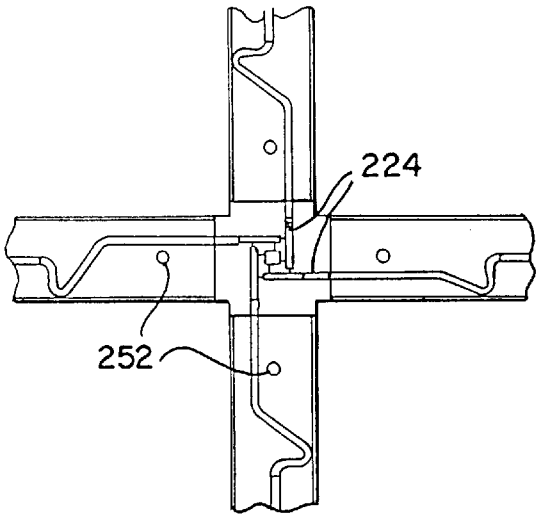
FIG. 26C is a top view of a wall panel junction showing a four-way connection of power distribution servers located in the adjacent wall panels.
Figure 26A:
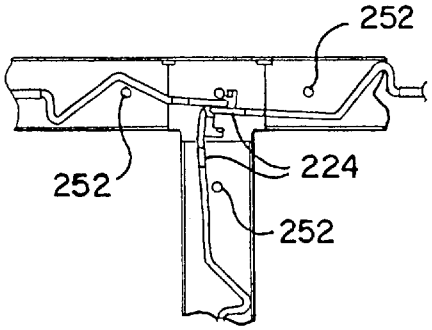
FIG. 26A is a top view of a wall panel junction showing a three-way connection of power distribution servers located in the adjacent wall panels.
Figure 26B:
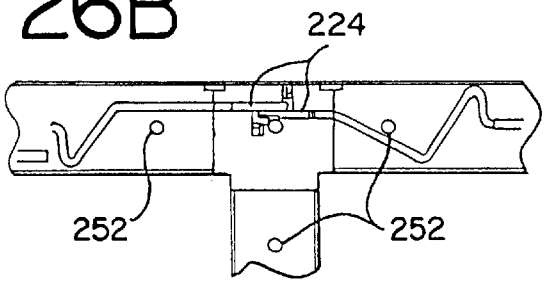
FIG. 26B is a top view of a wall panel junction showing a two-way connection power distribution servers located in the adjacent wall panels.

Referring to FIGS. 25–27, the harness includes a receptacle bracket 566, a spring tab 572 and a plurality of module bracket hooks 574. A plurality of receptacle modules 226 are secured to the harness by engaging the bracket hooks 574 with mounting lugs 564 disposed on the module. Each module 226 is electrically connected to the harness 222 at one of a four receptacle ports 576. Similarly, conduit 276 from an outlet box installed in the panel, as described below, preferably includes a connector that can electrically engage one of the receptacle ports in place of a receptacle module. For a complete description of the power distribution server, including the power harnesses, one is directed to U.S. Pat. No. 5,013,252, issued to Neinhuis et al. on May 7, 1991, the disclosure of which is hereby incorporated by reference. The harness also includes electrical connector ports 224 positioned at the end of the harness and which provide a means for electrically connecting adjacent panels, such that a first panel receives power from a second panel. A commercially available harness, Model No. 225409, is sold by PENT Assemblies of Kendallville, Ind. FIGS. 26A–C show various configurations of panels electrically interconnected. In this way, an entire system of panels can be electrically connected and provide power to users at individual work spaces.

Referring to FIG. 14, the mounting strip 190 is disposed between the bracket 200 and the core member 32. The mounting strip 190 has a pair of elongated grooves 194 running longitudinally along the edges of the mounting strip 190. The mounting strip supports a base cover 230. The base cover 230 includes a pair of side walls 232 and a bottom wall 234, as shown in FIGS. 14 and 15. The side walls 232 and bottom wall 234 are hinged along the longitudinal length of the base cover, preferably by using a flexible hinge material 236. The cover members can also be mechanically hinged. The upper portion of each wall includes a beaded flange 238 that is disposed in the groove 194 in the mounting strip. When mounted on the mounting strip, the base cover 230 forms and defines a horizontal channel for storing and protecting cables and wires beneath the panel. The lower horizontal channel also provides a concealed passage way for the cables and wires as they pass from one panel to the next.

Referring to FIG. 2, the bottom wall 234 of the base cover includes a slot 240 at each end which is adapted to receive a support leg 250 extending down from the vertical frame members 14, as explained below. The side walls 232 extend between the lower edge of the wall panel and the floor and include openings 242 adapted to allow a user to access outlets in the modules 226 secured to the power distribution server, which is mounted to the bottom of the lower frame member. Each end of the side wall 232 on the base cover includes a flexible strip 244 that extends outwardly from the end of the panel. When two panels are installed end-to-end, the opposing flexible strips 244 overlap and conceal the gap between the panels.

Referring to FIGS. 2 and 15, the wall panel is supported on and spaced apart from the floor by a support leg 250 attached to each vertical frame member 14. A support bracket 260 is mounted to the bottom of each core member 28 on the inner surface 48 of the core member. The bracket 260 is mounted in the space 106 provided between the end of the lower core member and the bottom end of the vertical core member, as shown in FIG. 12. The bracket 260 includes a U-shaped sleeve portion 262 and a pair of flanges 264. The flanges 264 are fastened to the inner surface of the core member 28 such that the sleeve portion 262 forms an opening 266 with the surface of the core member.

The support leg 250 includes a shaft 252 having a shoulder 254 and a foot 256. An upper portion of the shaft is received in the opening 266 formed by the support bracket and core member until the shoulder 254 of the shaft engages the bottom of the 260 bracket. The bottom of the shaft 252 is threaded and threadably engages the foot member 256 whereby the height of the wall panel can be adjusted by rotating the foot 256 relative to the shaft 252.

Figure 8:
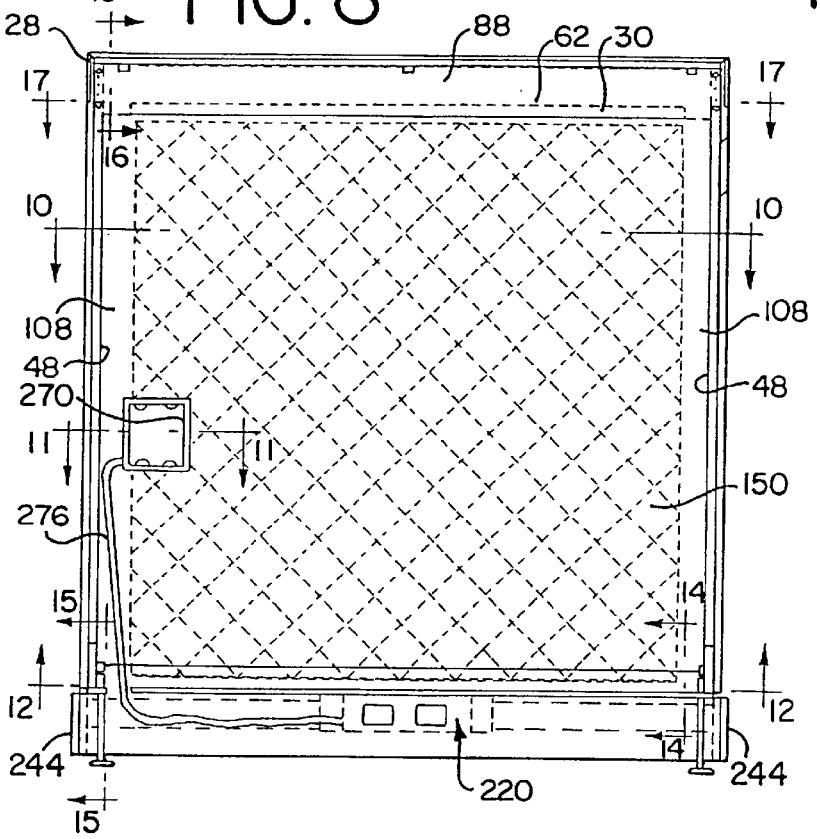
FIG. 8 is a side view of a wall panel.
Figure 9:
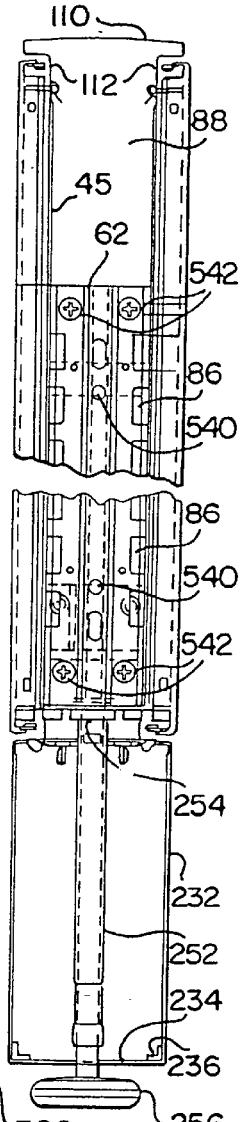
FIG. 9 is an end view of a wall panel with the power distribution server omitted.

In a preferred embodiment, an outlet box 270 is installed inside the wall panel frame between the upper and lower frame members 16, 18. As shown in FIGS. 8 and 11, the outlet box 270 is first-bolted to a plate member 272, preferably a piece of hardboard. The plate member 272 is adhesively bonded to the inner surface 122 of one of the wall members. The opposite wall member has an opening 274 aligned with the outlet box 270 so as to allow the user access to the box. An outlet cover 275 can be installed over the opening. The outlet box is electrically connected to the power distribution server with an electrical conduit 276 that is disposed in the vertical channel 108, as described above. Outlets, which are not shown, are installed in the outlet box. It should be understood that the same or similar box can be installed to provide access to data and communication wiring and cables. The outlet box also can be field installed by cutting a hole in one of the thin sheets, the barrier sheet and the wall member.

Figure 19:
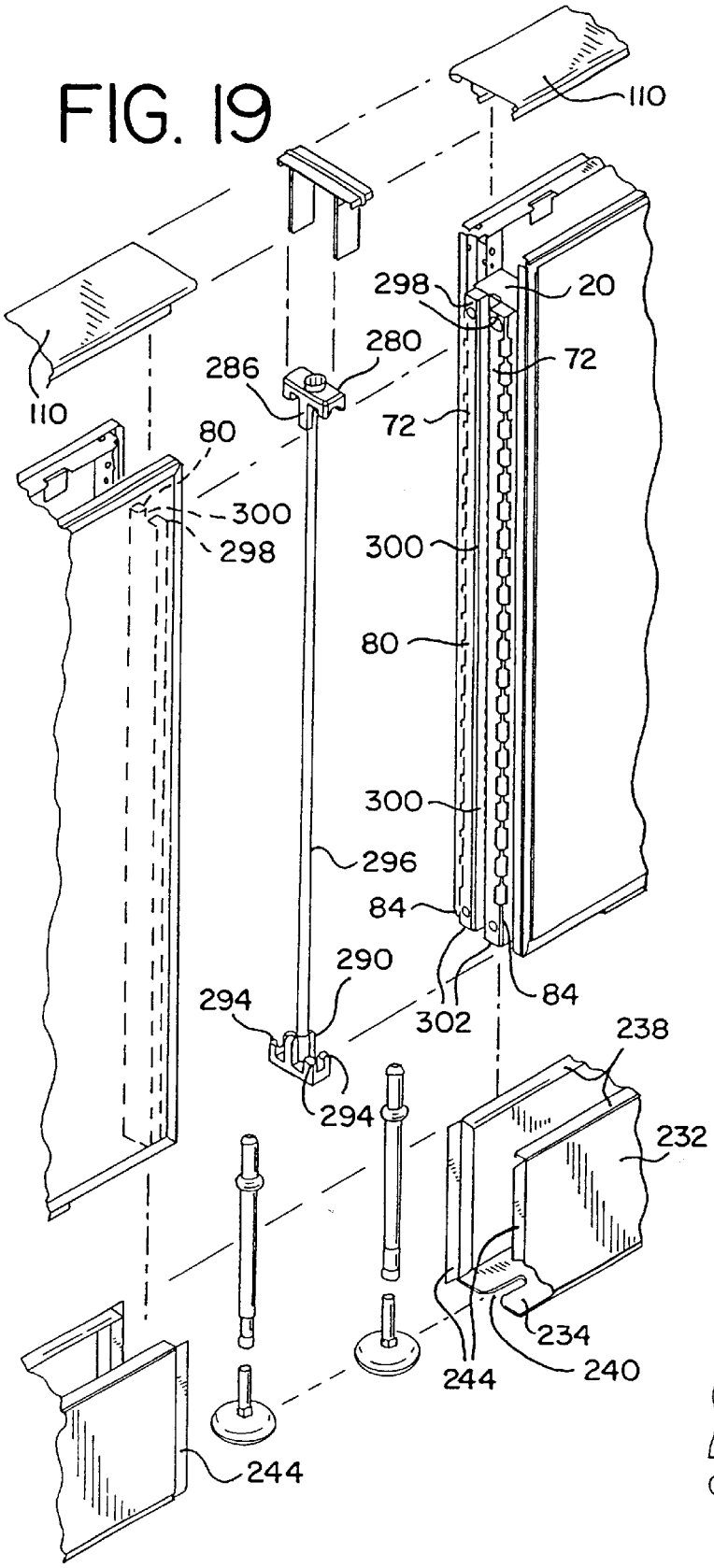
FIG. 19 is an exploded perspective view of two wall panels placed end-to-end without the fabric installed.
Figure 20:
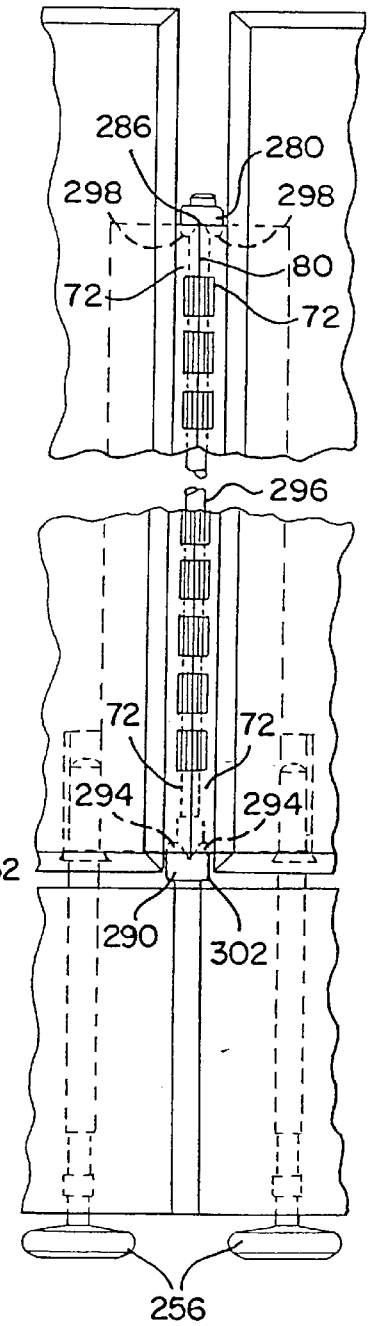
FIG. 20 is a side view of two wall panels connected together without the fabric installed.
Figure 28:
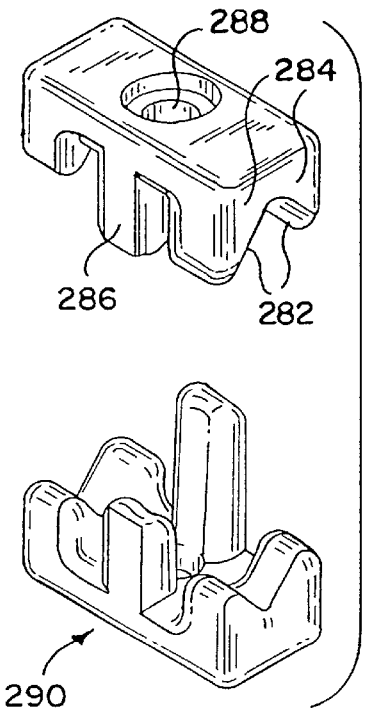
FIG. 28 is a perspective view of the upper and lower draw blocks.
Figure 29:
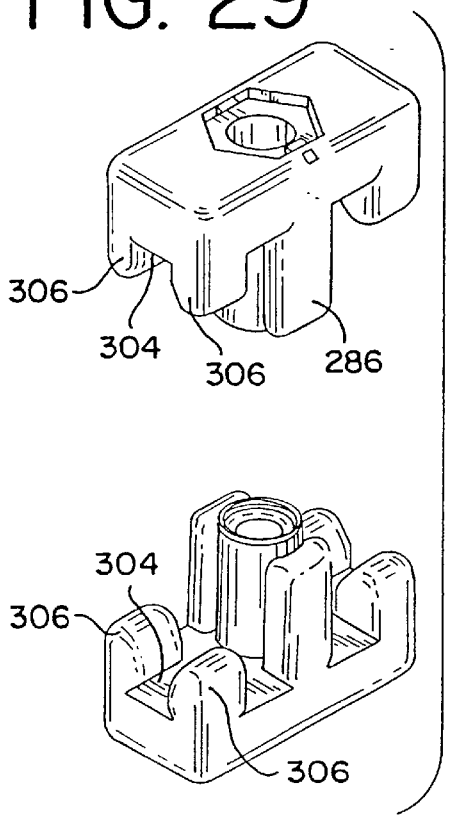
FIG. 29 is a perspective view of an alternative configuration of the upper and lower draw blocks.
Figure 30:
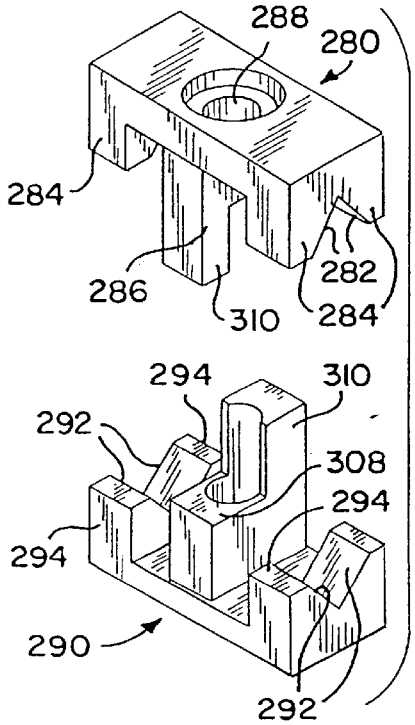
FIG. 30 is a perspective view of an alternative configuration of the upper and lower draw blocks.

The wall panels can be connected to form a system of panels that defines and divides large office spaces into work spaces. For example, the wall panels can be connected end-to-end in a simple linear arrangement as shown in FIGS. 19 and 20. In such an arrangement, the panels are positioned adjacent to each other such that opposing outer surfaces 80 of the hanger brackets are in a proximal relationship. An upper draw block 280 is provided which has a downwardly facing V-shaped draw surface 282 defined by four wedge members 284, as shown in FIGS. 28–30. The upper draw block 280 includes a middle portion 286 that has a hole 288. Similarly, a lower draw block 290 has an upwardly facing V-shaped draw surface 292 defined by four wedge members 294. A draw rod 296 connects the two draw blocks 280, 290.

Referring to FIGS. 19–20, the upper draw block 280 is positioned such that the wedge members 284 engage the top edge 298 of the hanger bracket on the adjacent panels by inserting the wedge members 284 into the inwardly facing channels 72. The middle portion 286 of the draw block is disposed in the space formed between the outwardly facing channels 300, which formed by the inner legs of the channel and the bridge portion.

Figure 32:
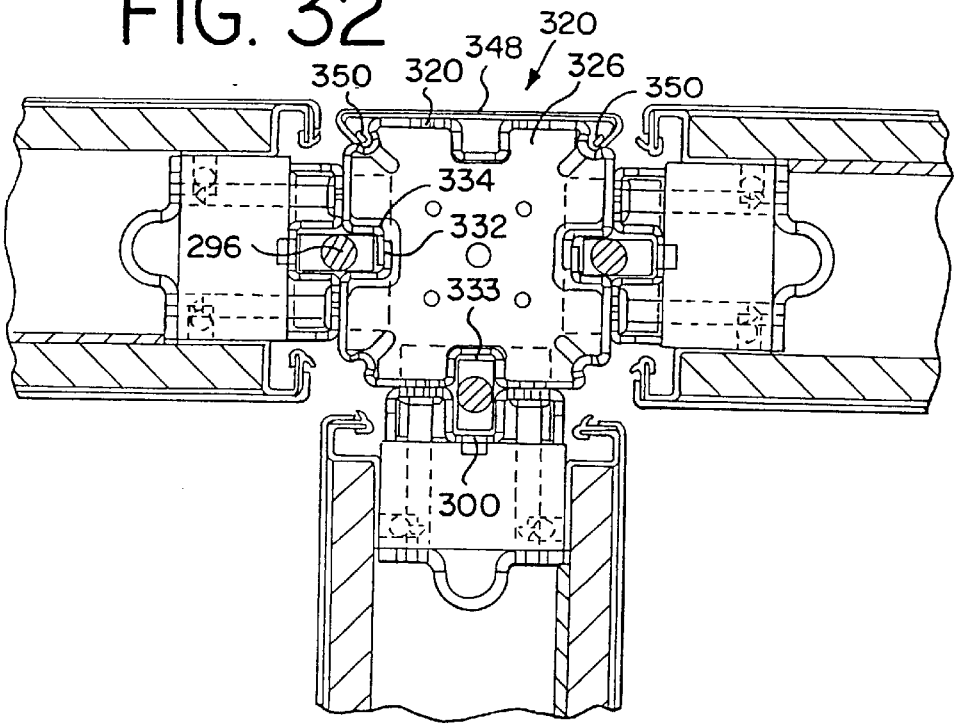
FIG. 32 is a top cross-sectional view of three wall panels connected to a corner post.
Figure 33:
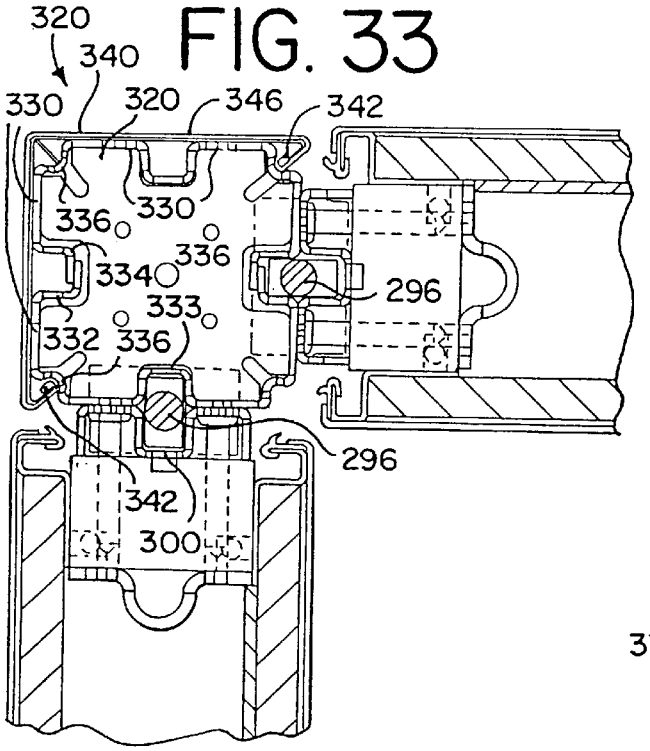
FIG. 33 is a top cross-sectional view of the wall panels connected to a corner post.
Figure 34:
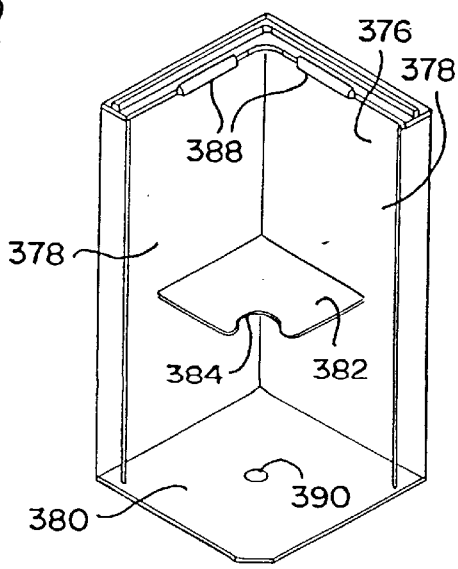
FIG. 34 is a perspective view of a corner post base cover.
Figure 35:
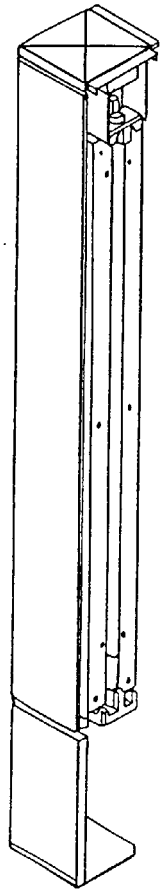
FIG. 35 is a perspective view of a draw rod and draw blocks engaging a corner post.

Similarly, the lower draw block 290 is inserted into the bottom end of the channels 72 such that the wedge members 294 engage the bottom edge 302 of the hanger bracket 70 and the middle portion is received in the space formed by the channels 300. The draw rod 296 is rotatably connected to the lower draw block and threadably engages the upper draw block. The draw rod is disposed in the space formed by the two outwardly facing channels 300 of the opposing hanger brackets as shown in FIGS. 32–33. When rotated, the draw rod threadably engages the upper draw block, pulling it closer to the lower draw block. As the draw rod is tightened, the draw surfaces 282, 292 of the draw blocks operably engage the ends 298, 302 of the hanger brackets and pull the hanger brackets together. In an alternative embodiment shown in FIG. 29, the draw blocks include a flat surface 304 between the wedge members 306. When drawn together, the ends of the hanger brackets engage the flat surface 304.

As shown in FIG. 30, one embodiment of the draw blocks includes a landing 308 and a tang member 310 extending from the landing on one side of the opening 288. This configuration facilitates the installation of the draw blocks and draw rod. In particular, the installer can rest the land portion 308 of the upper draw block on the bridge portion 74 of one of the hanger brackets, while the tang member 310 is disposed in the channel 300 to align the draw block with the hanger bracket. In this way, the connector assembly, i.e., the draw rod and two draw blocks, can be positioned and retained by a first panel as the second wall panel is moved into place next to the first panel. The draw rod 296 and blocks 280, 290 can then be lifted up and aligned with the channels 72 on the ends of both panels. The draw rod 296 is then tightened as explained above so as to connect the two panels.

As shown in FIGS. 4–5 and 31–33, two or more panels can also be connected in a perpendicular relationship. In such a configuration, a corner post 320 is installed between adjacent panels. The corner post 320 includes a substantially square, elongated tube 322 and an upper and lower plate 324, 326 mounted inside each end of the tube, preferably by welding. Each plate 324, 326 includes a threaded hole 328 in the middle of the plate. A pair of inwardly facing channels 330 are formed longitudinally along each side of the tube 322. The inwardly facing channels 330 also form an outwardly facing channel between them. Preferably, the tube 322 is made from two overlapping C-shaped pieces 332, 334 welded together as shown in FIGS. 32–33.

Figure 4:
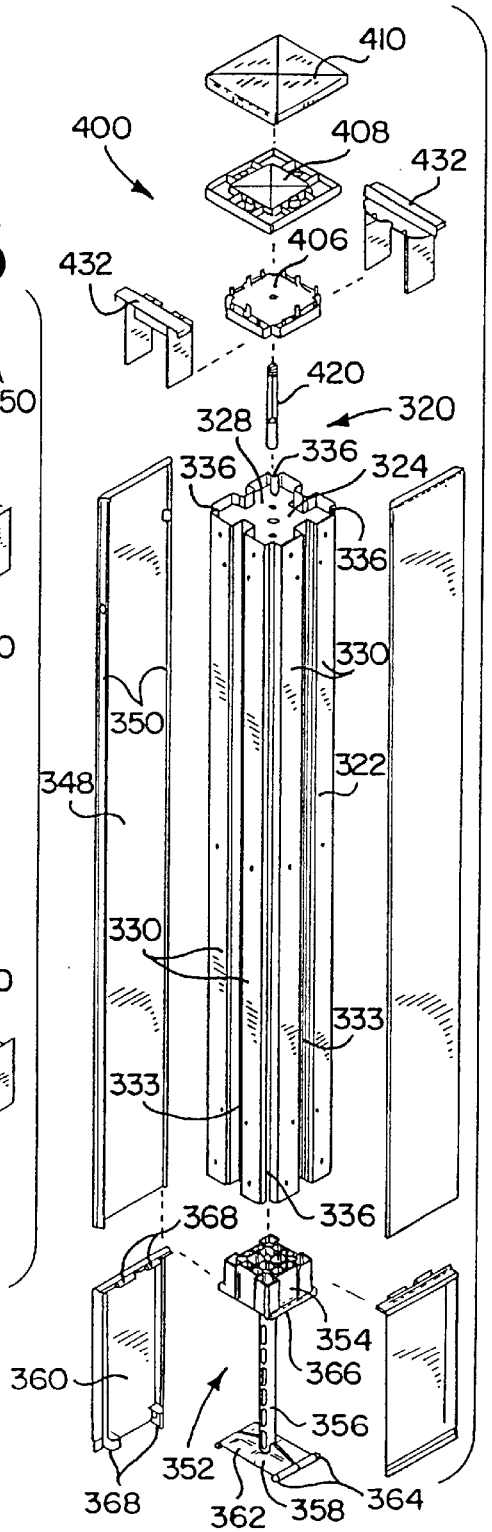
FIG. 4 is an exploded view of a corner post configuration.
Figure 5:
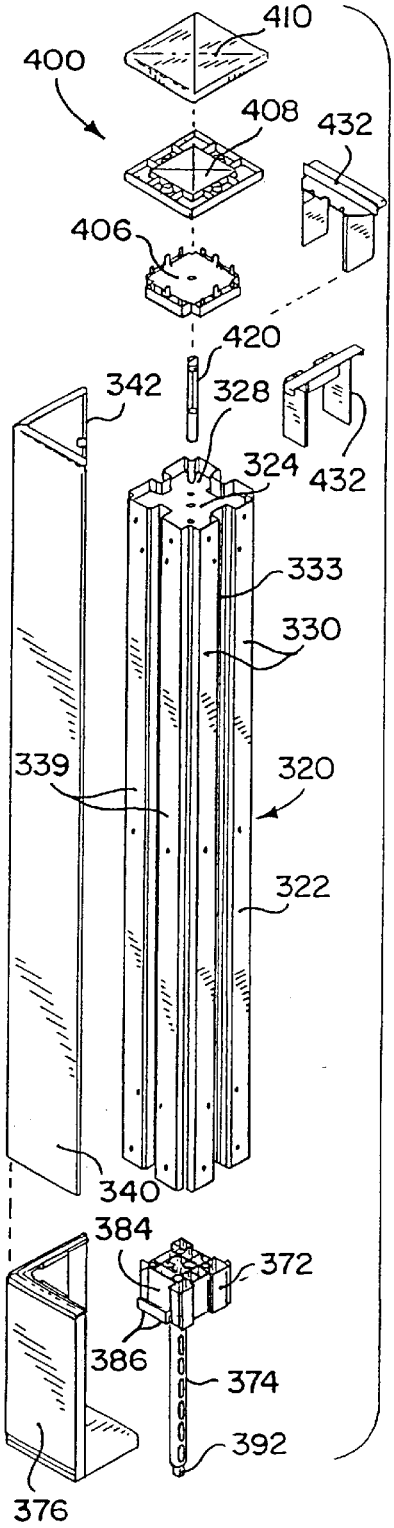
FIG. 5 is an exploded view of an alternative embodiment of a corner post configuration.

Referring to FIGS. 4 and 5, each corner of the tube includes an outwardly facing groove 336 that runs longitudinally along the length of the tube 322. As shown in FIGS. 32 and 33, the groove 336 is preferably formed by the outer legs of the channels 330, which are joined at the corners of the tube at approximately 90°.

Figure 31:
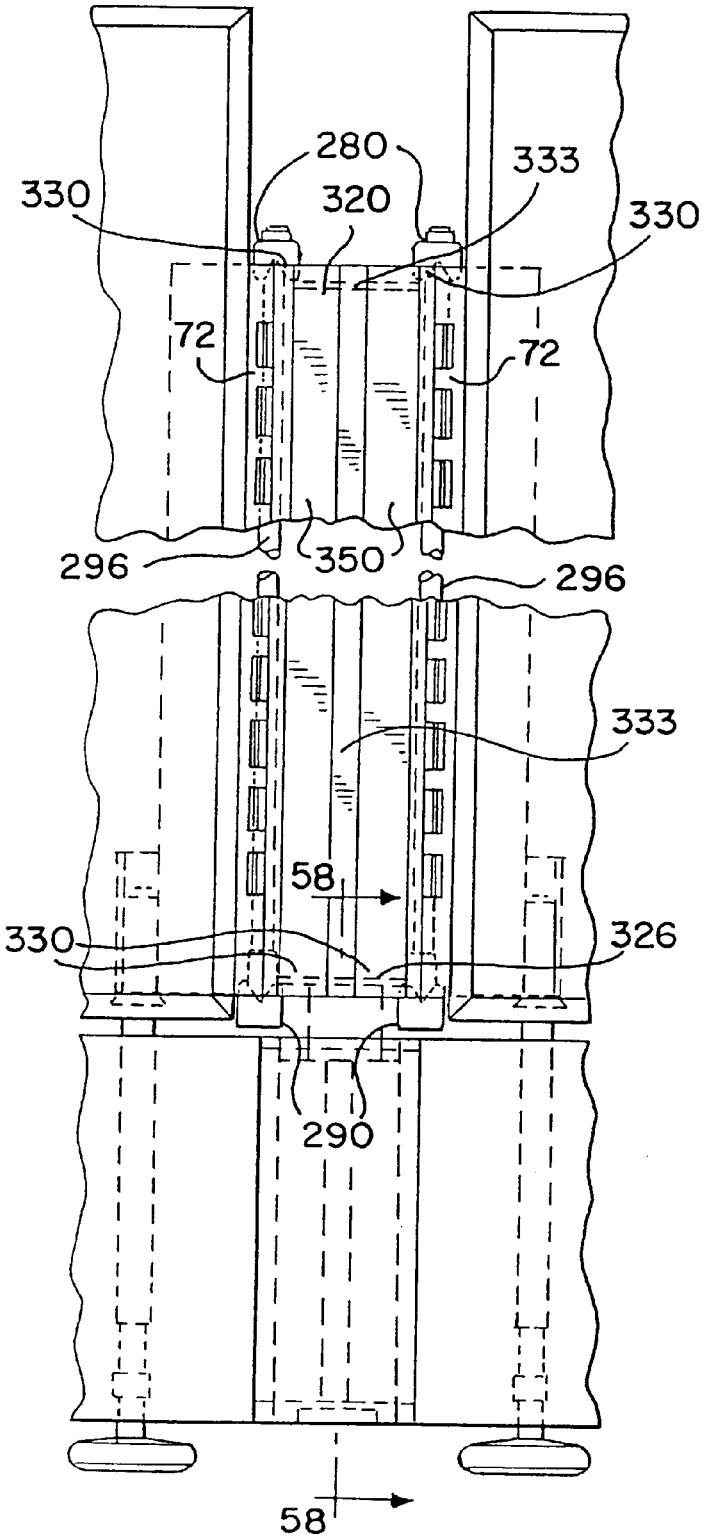
FIG. 31 is a side view of two wall panels connected to a corner post.

As shown in FIG. 31, each wall panel is connected to the corner post in the same way as described above. An upper and lower draw block 280, 290 engage the top and bottom edge of the two channels 330 on the side of the tube and the two channels 72 of the hanger bracket mounted on the side of the wall panel being connected. The draw rod 296, connecting the draw blocks, is tightened to pull the draw blocks together and to pull the wall panel towards the corner post so that the hanger bracket engages the side of the tube. It should be understood that one, two, three or four wall panels can be connected to the corner post at any time depending on the desired configuration.

As shown in FIGS. 5 and 33, when two wall panels are connected to the corner post 320 at 90°, the opposing two sides of the corner post are concealed by an V-shaped cover member 340 adapted to be disposed on the adjacent, perpendicular sides of the corner post. The cover member 340 includes a beaded portion 342 running longitudinally along the side edges 344 of the cover. The beaded portions 342 are adapted to engage the outwardly facing groove 336 formed along each corner of the tube 322. The beaded portion 342 extends diagonally inward from the cover at approximately 45°. The cover member 340 includes an outer layer of fabric 346 that matches the thin sheet of fabric disposed on the adjacent wall panels.

When two wall panels are arranged in a 180° relationship on opposite sides of the tube, a flat cover member 348 can be installed on one or both of the exposed sides of the tube 322 as shown in FIGS. 4 and 32. The flat cover member 348 includes diagonally facing beaded portions 350 running longitudinally along its length.

Referring to FIG. 4, a support member 352 is attached to the bottom of the tube member 322. The support member 352 includes a base portion 354, a leg 356 and a foot 358. The base portion 354 is attached to the lower plate 326 secured in the bottom end of the tube 322. A base cover 360 is installed on the support member 352 to conceal the support member 352 and the space below the panel. The base cover 360 extends between the base portion 354 and the foot 358. The foot 358 includes a bottom member 362 and a pair of cylindrical lug members 364 positioned on opposite sides of the bottom member 362. The base portion 354 includes slotted portions 366 positioned on the same side as the lug members 364. The base cover 360 includes upwardly facing tab members 368 that engage the slotted portions 366 and a pair of flange members 368 that engage the lug members. The leg 356 is preferably a thin shaft that allows cables and wires to pass between the leg 356 and base cover 360 as they are passed between adjacent panels. In this way, the cover 360 forms part of the lower horizontal channel. It should be understood that the support does not engage the floor, but rather is provided to support the base cover member, which conceals and protects wires in the lower channel.

When two panels are attached to a corner post at 90°, the support does not include a foot. In this arrangement, the support includes a base portion 372 and a leg 374 as shown in FIG. 5. The base cover 376, shown in FIG. 30, includes two walls 378, a base plate 380 and a guide plate 382. The base portion 372 includes a slot 384 and two tab members 386 on two sides of the base portion. A lip portion 388 is positioned on the top of each base cover wall 378. When installed, the lip portion 388 is inserted into the slot 384 as the two tab members 386 engage the bottom of the lip 388 to releasably secure the base cover 376 to the base portion 372. The guide plate 382 extends between the walls 378 and lies parallel to the base plate 380. The guide plate 382 includes a slot 384 adapted to receive the leg 374 of the support. The base plate 380 includes an opening 390 that is adapted to receive an end of the leg, which includes a lug 392. In this way, the base cover is supported by the support base portion and is stabilized by the leg.

Figure 7:
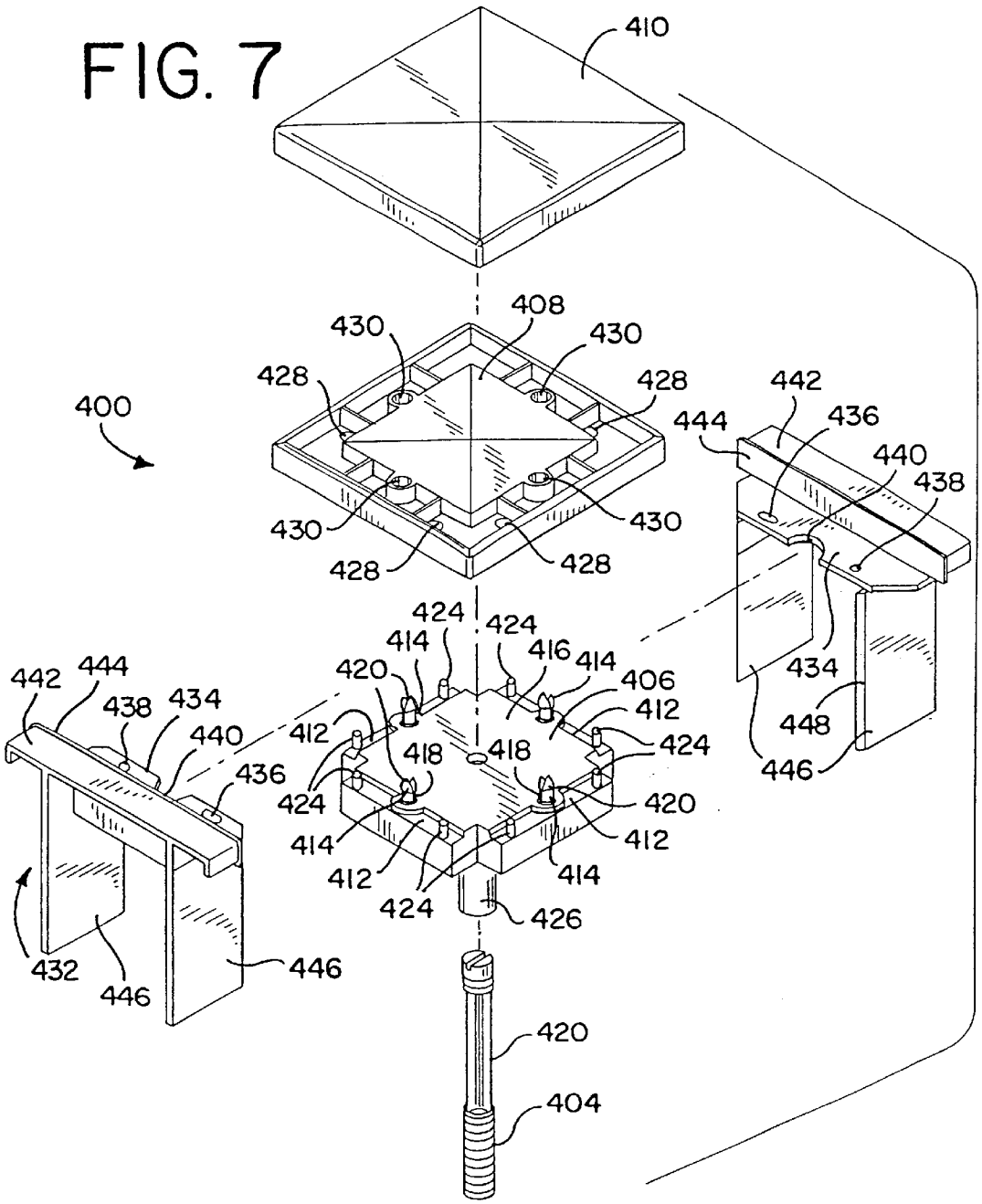
FIG. 7 is an enlarged exploded view of a corner post cap.

As shown in FIGS. 4, 5 and 7, the corner post 320 also includes a cap assembly 400 adapted to span the gap between adjacent top caps 110 installed on top of each wall panel. Preferably, the cap assembly 400 is plastic. FIGS. 4, 5 and 7 show the cap assembly which includes a post member 420. The post member 420 has a threaded end 404 that threadably engages the threaded hole 328 in the upper plate 324 secured in the end of the tube 322. The cap 400 also includes a base member 406, a lock member 408 and a cover member 410. The base member 406 includes a step portion 412 on each side of the base and a primary post member 414 extending upwardly from the middle of each side of the top surface 416 of the base member. Each primary post member 414 includes a shaft portion 418 and a head portion 420. Each primary post member 414 is slotted so as to make the head and shaft portions flexible and resilient. Two secondary post members 424, positioned on opposite sides of the primary post member, extend upwardly from each step portion 412 of the base member. A cylindrical sleeve portion 426 extends downwardly from the bottom of the base member 406. The sleeve portion 426 is adapted to receive the top of the post member 402, so that the post member supports and rotatably engages the base member 406. The post member 402 allows the height of the corner post cap to be adjusted as it threadably engages the upper plate 324 in the tube 322. In addition, the post member 420 is slender so that cables wires and the like can be disposed around the post member as they pass from the upper horizontal channel 88 of one panel to the next.

The lock member 408 is rectangular and includes openings 428 adapted to receive the secondary post members 424. The lock member 408 also includes four openings 430 adapted to receive the head and shaft of the primary post member 414. A shoulder is disposed inside each opening so that when the primary post member is inserted into the opening, the head extends through the plate member and engages the shoulder to thereby releasably secure the plate member to the base member. The cover member 410 is releasably secured to the top of the lock member 408.

Referring to FIGS. 3–7, a light seal 432 is provided to connect the top cap on the wall panel with the corner post cap. The light seal 432 includes a mounting flange 434 having two holes: a slotted hole 436 and a round hole 438. The holes 436, 438 are adapted to receive the secondary post members 424. The mounting flange 434 also includes a semicircular cut-away portion 440. The light seal 432 is installed on the base member 406 by inserting the secondary post members 424 into the openings 436, 438 in the mounting flange 434. The bottom of the mounting flange 434 engages the step portion 412 so that the top of the flange lies flush with the top surface of the base member 406. The cut-away portion 440 is disposed around the primary post member 414. The lock member 408 is installed on the base member 406 so as to releasably secure the light seal 432 to the base member 406.

The light seal 432 includes an insert portion 442 with a rib 444 defining an end of the insert portion 442. The insert portion 442 is adapted to be received in the open end of the top cap 110 mounted on each wall panel. The light seal 432 also includes downwardly extending legs 446. The legs extend downwardly between the upwardly extending sidewall members 36 of the adjacent upper frame member and the cover member 340, 348 disposed on the side of the corner post so as to prevent light from penetrating the gap between the two members. Each leg 446 also includes a beveled edge 448 that mates with an opposing edge of an adjacent leg when two light seals are installed at 90° to each other. The light seal is preferably made of plastic and the legs can be trimmed to the proper length before installation.

Figure 6:
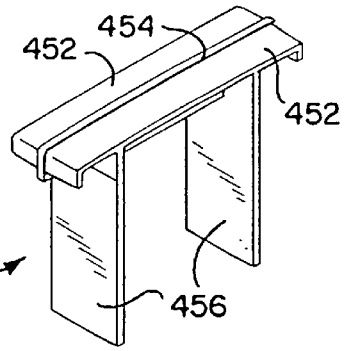
FIG. 6 is an enlarged perspective view of a panel-to-panel light seal.

Referring to FIG. 6, a light seal 450 is provided to bridge the gap between the top caps on two panels placed end-to-end and connected to each other. In this embodiment, the light seal 450 includes two insert portions 452 facing away from each other and that are separated by a rib 454. The insert portions 454 are received in each wall panel top cap 110. The rib 454 provides a smooth and continuous transition between the top caps 110. The legs 456 of the light seal extend downwardly and conceal the gap between the adjacent upwardly extending sidewalls of the two panels.

Referring to FIGS. 36 and 38–40, a connector is provided to attach a shorter wall panel to a taller wall panel. In this configuration, an upper draw block 460 includes a pair of wedge members 462 on one side and a pair of hook members 464 on the opposite side. The hook members 464 are adapted to engage the slots 86 in the hanger bracket 70 attached to the side of the taller wall panel. The wedge members 462 engage the top 298 of the hanger bracket channels 72 on the shorter wall panel as described above. To connect the panels, the draw rod 296 is tightened to pull the two wall panels together. A light seal 470 is installed on the shorter panel so that its legs 472 are disposed on either side of the upper draw block 460. An insert portion 474 of the light seal 470 is received in the top cap 110 attached to the top of the shorter panel. The end of the light seal 470 is defined by a flat surface 478 which extends downwardly from a rib 476. The flat surface 478 abuts the hanger bracket 70 on the taller panel.

Figure 3:
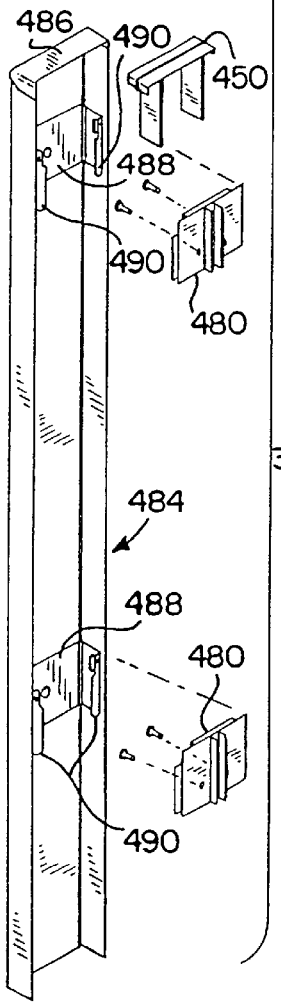
FIG. 3 is an exploded view of a wall panel end cover.
Figure 36:
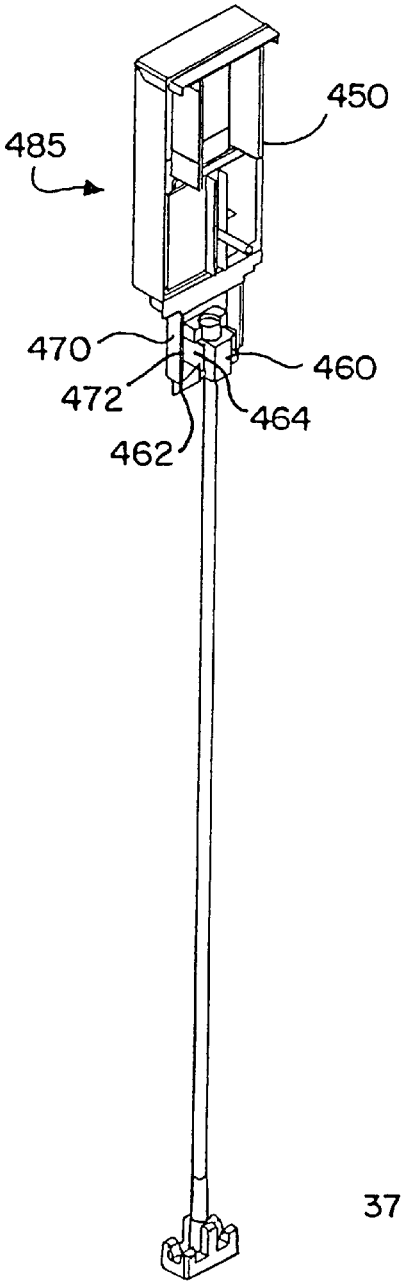
FIG. 36 is a perspective view of a draw rod with a partial end cover.
Figure 37:
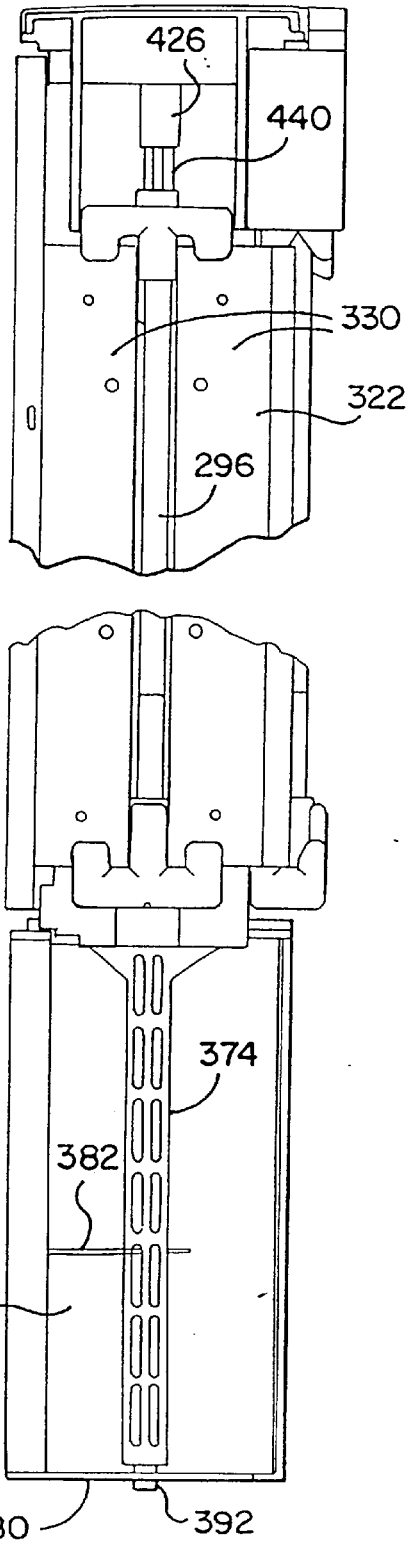
FIG. 37 is a side view of a draw rod and draw blocks engaging a corner post.
Figure 38:
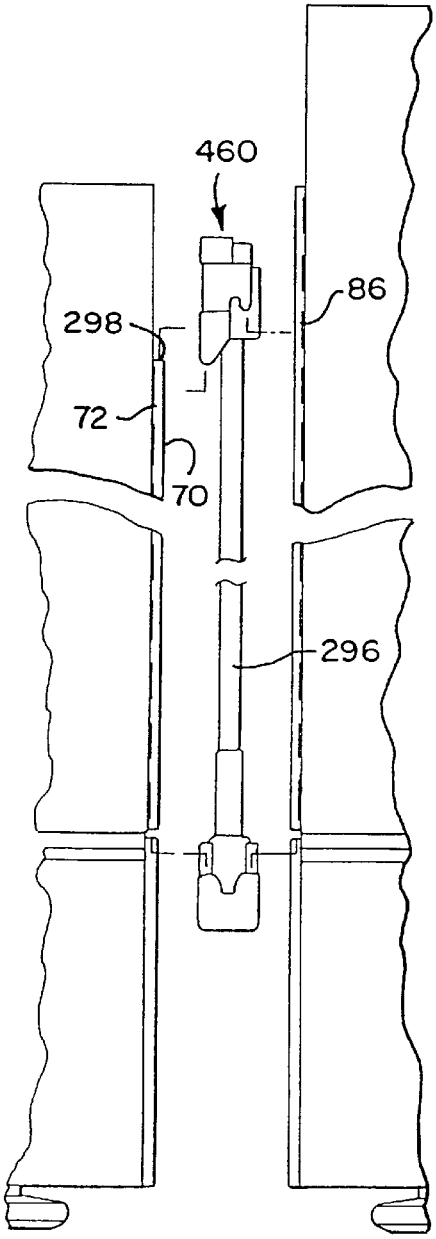
FIG. 38 is an exploded side view of different height wall panels with a draw rod and draw blocks interposed between the panels.
Figure 39:
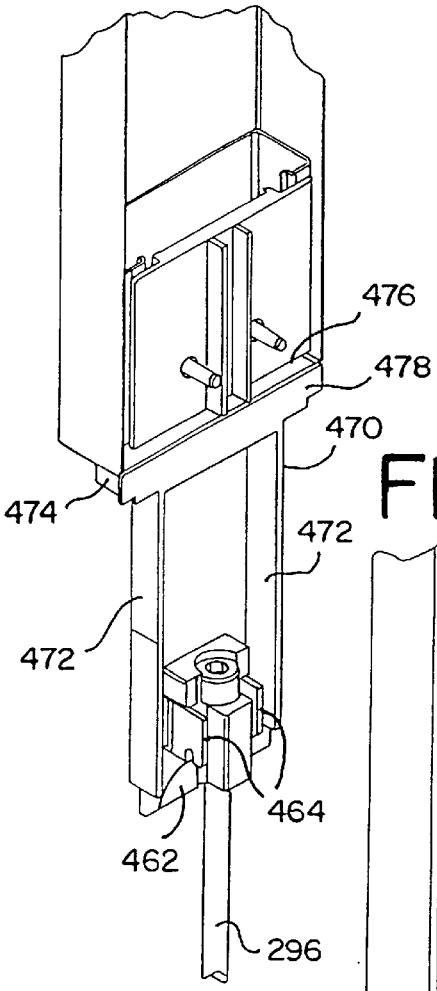
FIG. 39 is a partial inner perspective view of a draw rod with a partial end cover.

Referring to FIGS. 3, 36, 39 and 57, a pair of end cover brackets 480 are installed on the exposed end of any wall panel which is not connected to another wall panel or a corner post. The end cover bracket 480 includes a pair of outwardly facing grooves 482 running along opposite side edges of the bracket. A end cover 484 is attached to the bracket 480 on the end of the panel to provide a finished appearance. The cover 484 comprises a channel with a top wall 486 closing the upper end of the channel. The end cover also includes a pair of U-shaped brackets 488 mounted inside the channel. The brackets each include inwardly facing flanges 490 which are inserted into the grooves 482 in the end cover bracket mounted to the end of the wall panel. A light seal can be installed between the end cover and the top cap of the wall panel, as shown in FIGS. 3 and 36.

Figure 40:
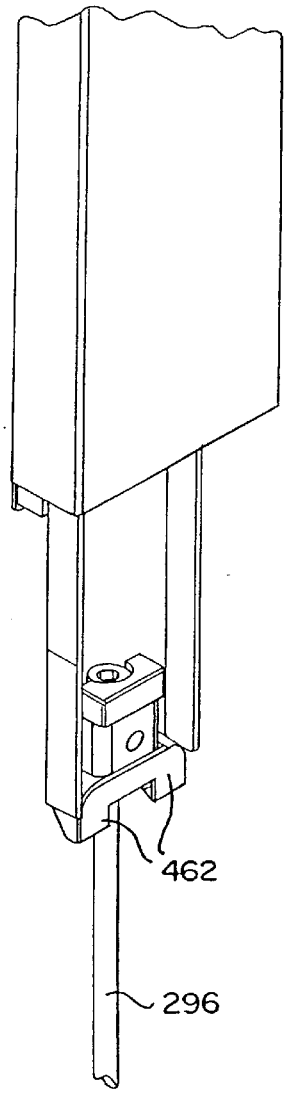
FIG. 40 is a partial outer perspective view of a draw rod with a partial end cover.

When installing a shorter panel adjacent to a taller panel, an end cover bracket 480 is mounted to the exposed portion of the hanger bracket and wall panel end extending above the shorter panel. A short end cover 485, shown in FIGS. 36 and 40, is mounted on the bracket so that the exposed upper portion of the taller wall panel is covered. A light seal 450 is then installed between the end cover and the top cap on the taller wall panel.

Figure 41:
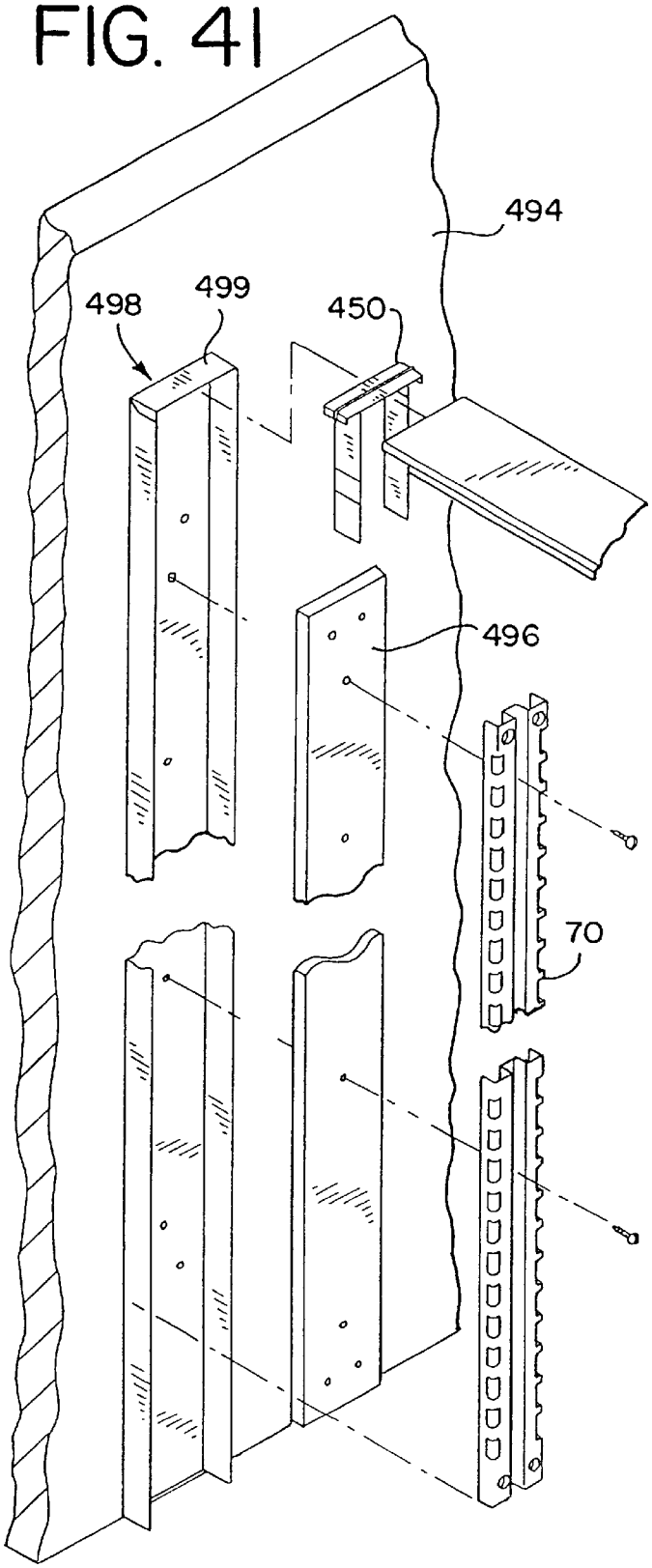
FIG. 41 is an exploded perspective view of a hanger bracket mounted on a permanent wall.
Figure 42:
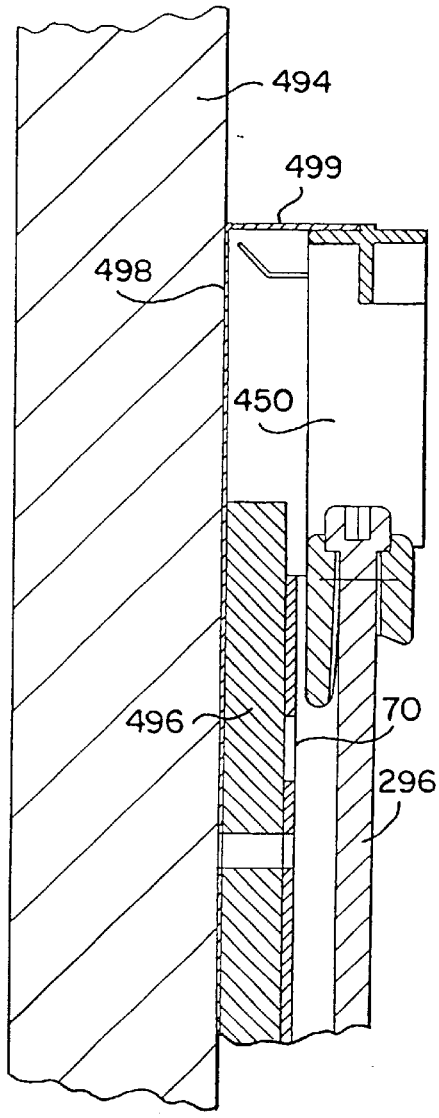
FIG. 42 is a partial cross-sectional view of the hanger bracket mounted on a permanent wall.

Referring to FIGS. 41–42, the wall panel also can be attached to a permanent wall 494. In this arrangement, a mounting plate 496 is disposed inside a channel-shaped cover 498 having a top wall 499, similar to an end cover. A hanger bracket 70, the cover 498 and mounting plate 496 are mounted on the permanent wall 494 with a plurality of fasteners. The wall panel is connected to the hanger bracket as described above, with a light seal 450 being inserted between the cover and the top cap of the adjacent panel.

The construction of the frame members and panel, as described above, is ideally suited for improved manufacturability of the wall panel. In particular, the method for making each vertical frame member includes providing a core member 28, a hanger bracket 70 and a pair of sidewall members 34, each having an edge portion 40 with an outer leg 118 having an outer surface. The hanger bracket 70 is attached to the outer surface 50 of the core member as discussed above.

Figure 50:
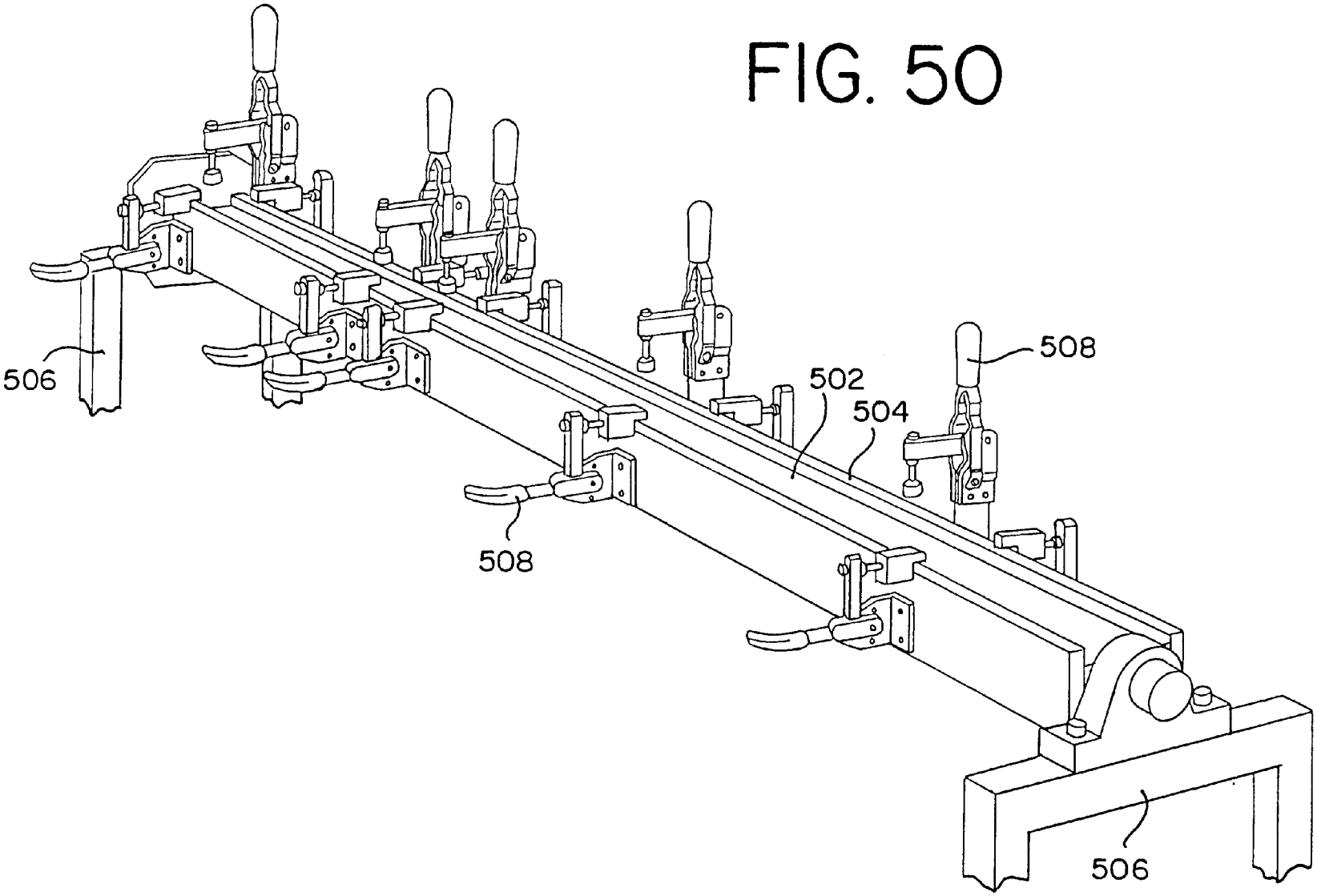
FIG. 50 is a perspective view of a vertical side frame member tool fixture.
Figure 51:
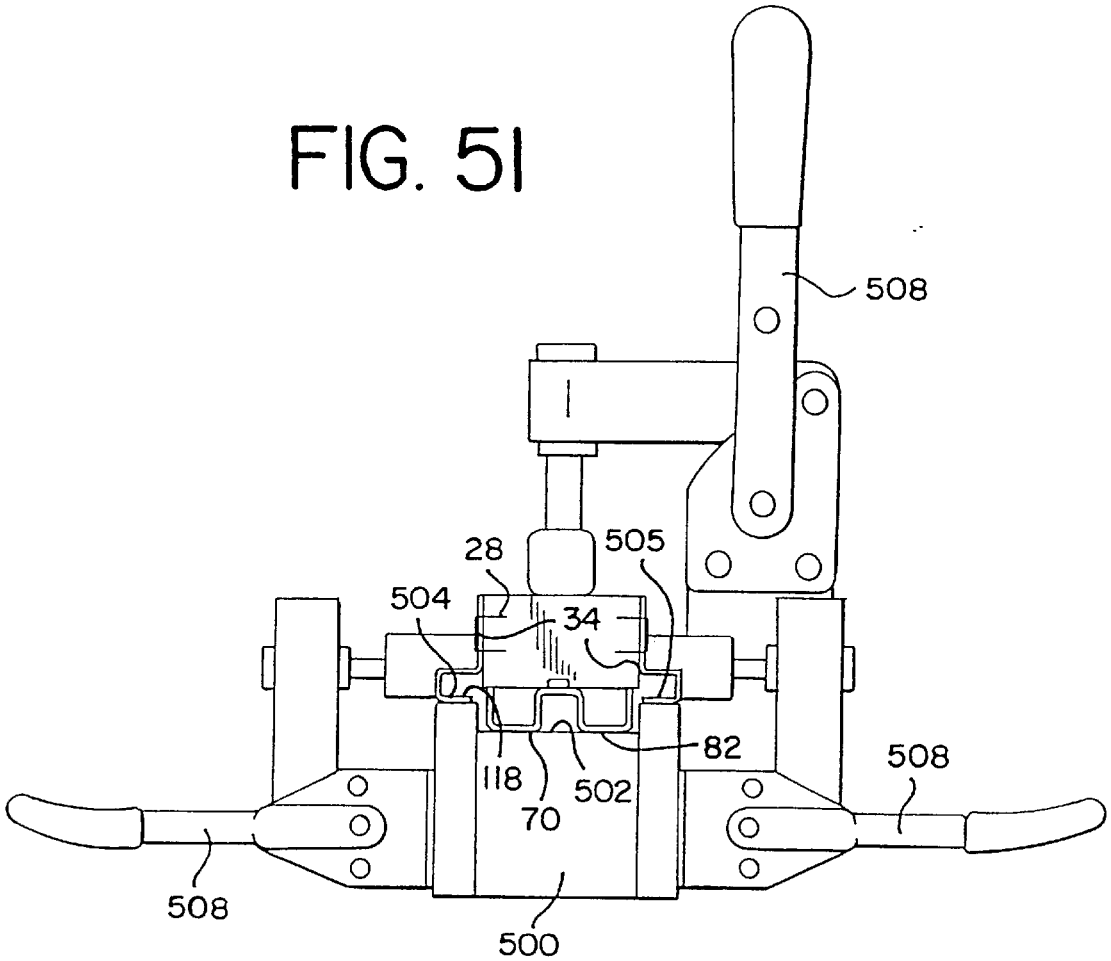
FIG. 51 is an end view of the side frame tool fixture with a side frame member installed therein.

Referring to FIGS. 50–51, the core member 28 and hanger bracket 70 are placed in a fixture 500, which has a first surface 502 spaced apart from a second and third surface 504, 505. The fixture 500 is rotatably attached to supports 506 at each end of the fixture 500. In this way, fixture surfaces can be provided on opposite sides of the same fixture for different frame members. The fixture is simply rotated so that the surfaces to be employed are accessible to the assembler.

As illustrated in FIG. 51, the core member 28 and hanger bracket 70 are positioned in the fixture such that an outer surface of the hanger bracket engages the first surface 502. The sidewalls 34 are then inserted into the fixture 500 on opposite sides of the core member. The ends of the sidewalls and the ends of the core member are positioned relative to each other in the fixture using a locator pin as the outer leg 118 of the edge portions of the two sidewalls engage the second and third surfaces 504, 505 of the fixture respectively. The core member, hanger bracket and sidewalls are clamped together in the fixture using a plurality of clamps 508. The sidewalls are then attached to the core member with a plurality of fasteners, preferably staples. Alternatively, the sidewalls can also be bonded to the core member using a suitable adhesive, or bonded and mechanically fastened.

It should also be understood by one skilled in the art, that various aspects of the assembly process can be automated. For example, the hand clamps shown in FIG. 51 can be replaced with pneumatically controlled clamps. Similarly, the fastening process can be automated, whereby the application of adhesive and stapling is done automatically.

By using a fixture as just described, the distance between the outer surface of the hanger bracket and the outer leg of each sidewall can be maintained as a relative constant with relatively tight tolerances. Thus, when two panels are installed end-to-end, the gap between adjacent opposing sidewalls will be maintained with tight tolerances so as to provide a uniform appearance when viewing a system of interconnected wall panels. In essence, the gap at each joint between adjacent panels is maintained as a relative constant. Moreover, this method of manufacture ensures that the slotted portion of the hanger bracket is always maintained a constant distance from the outer leg 118 of the sidewall edge portion. Thus, the user is ensured that components can be consistently installed on the hanger bracket without having to force the component past a protruding sidewall.

Another advantage of this method is realized when different thickness fabrics are installed on the panel. Typically, when a thicker fabric is installed on one panel, the fabric fills more of the gap between connected panels, and can therefore interfere with the installation of components on the hanger brackets, as well as creating a displeasing appearance as between adjacent joints. With the current construction, the distance between the first and second and third surfaces in the fixture can be altered to provide more or less distance between them so as to accommodate thicker or thinner fabrics respectively.

Figure 52:
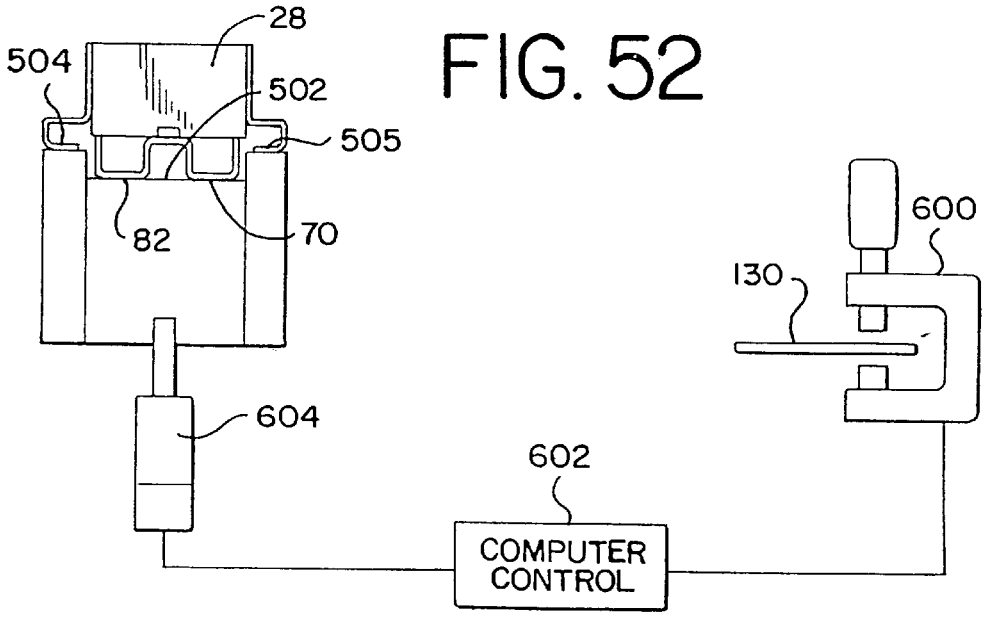
FIG. 52 is a schematic of an automated took fixture for assembling the side frame member.

Referring to FIG. 52, a scanner 600 or caliper can be used to measure the thickness of the fabric 130 being installed and provide that data to a computer. The computer 602 employs logic and actuates a servo motor 604 that changes the relative distance between the first and second and third surfaces so as to provide a uniform gap between panels once the fabric is installed. It should be understood that actuators could alternatively be used to adjust the second and third surfaces relative to the first surface. In this way, the second surface could be spaced a greater distance from the first surface than the third surface is from the first surface so as to accommodate two different thickness fabrics on each side of the panel. For example, it may be desirable to employ a heavy thick fabric on the outside wall of a panel system forming a walkway which experiences a lot of abuse, while providing a thinner fabric, for reasons of color selection etc., on the inside wall of the system forming the workspace.

Another advantage is realized by using a wooden core member in each of the frame members in that the sidewalls can be attached extremely fast and inexpensively with staples, rather than by expensive welding or mechanical screw and bolt type fasteners.

Figure 53:
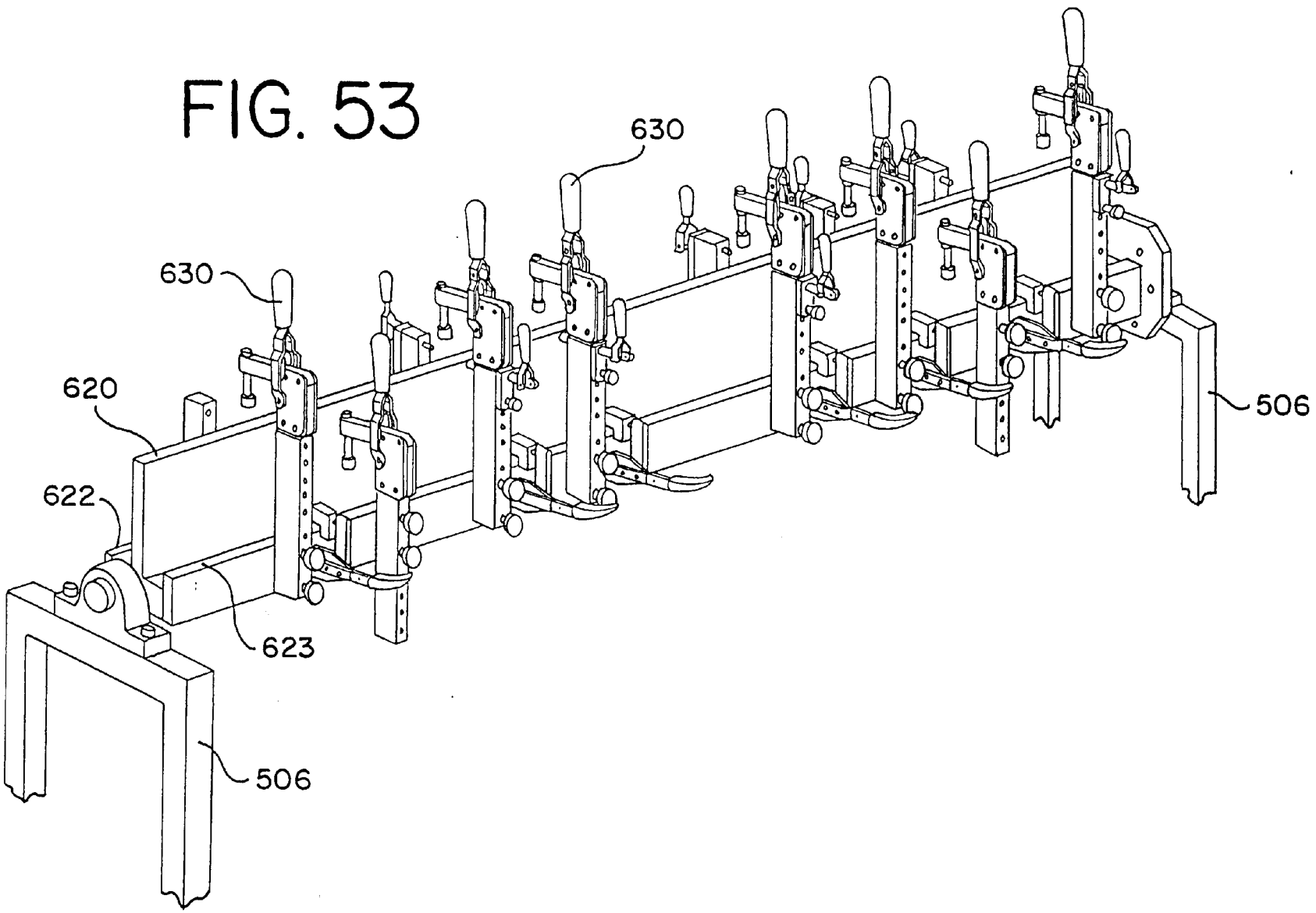
FIG. 53 is a perspective view of a upper and lower frame member tool fixture.
Figure 54:
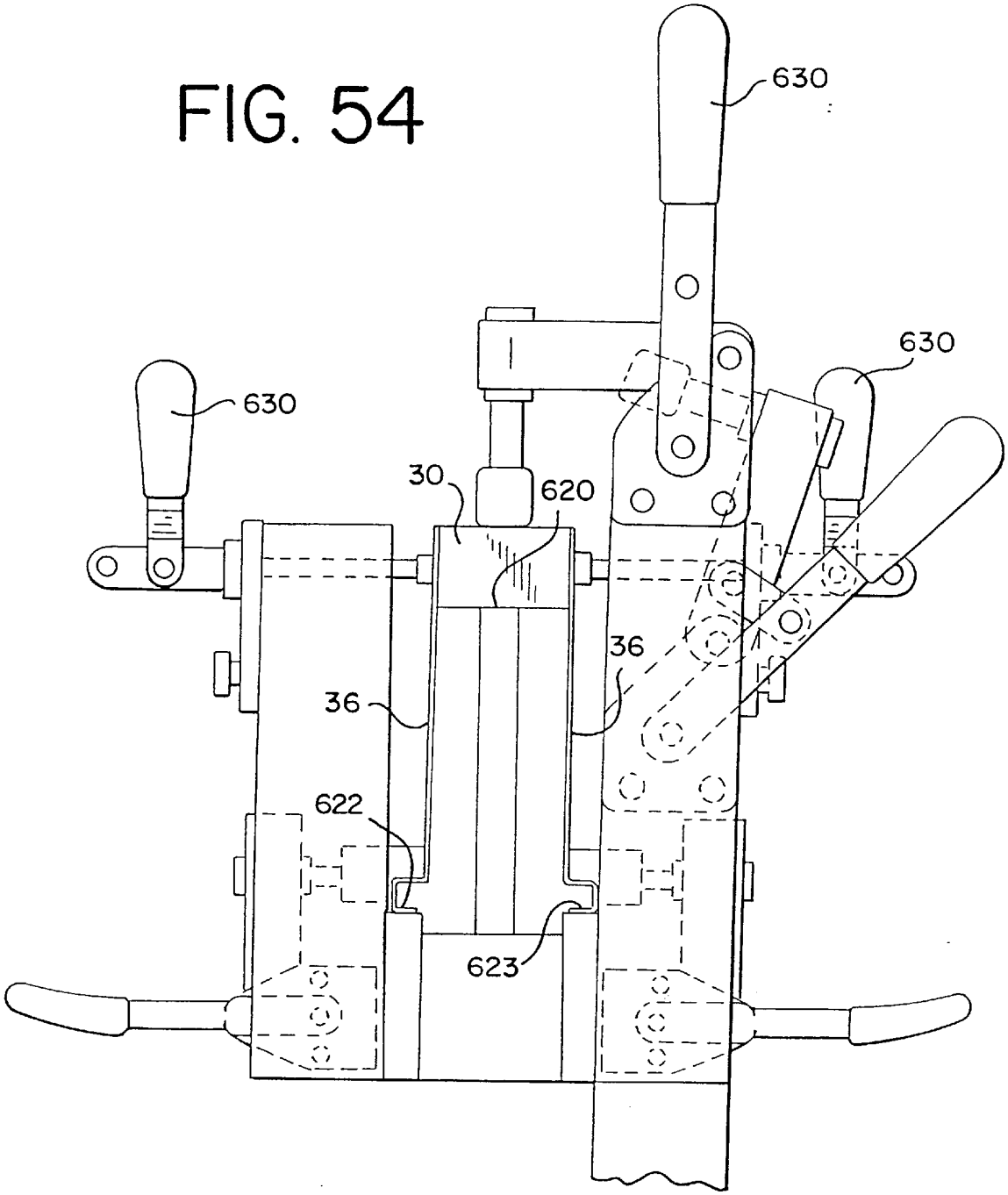
FIG. 54 is an end view of the upper frame tool fixture with an upper frame member installed therein.

The upper and lower frame members are made in a similar manner, except that the first fixture surface 620 engages the core member rather than the hanger bracket as shown in FIGS. 53–54. The sidewall members are installed so that the outer legs 118 engage the second and third fixture surfaces 622, 623 respectively. The bracket and mounting strip are installed on the outer surface of the lower core member with mechanical fasteners. The groove 33 positioned along the bottom of the bottom core member allows space for ends of a tool locator which positions the bracket and mounting strip relative to the bottom of the panel.

Figure 55:
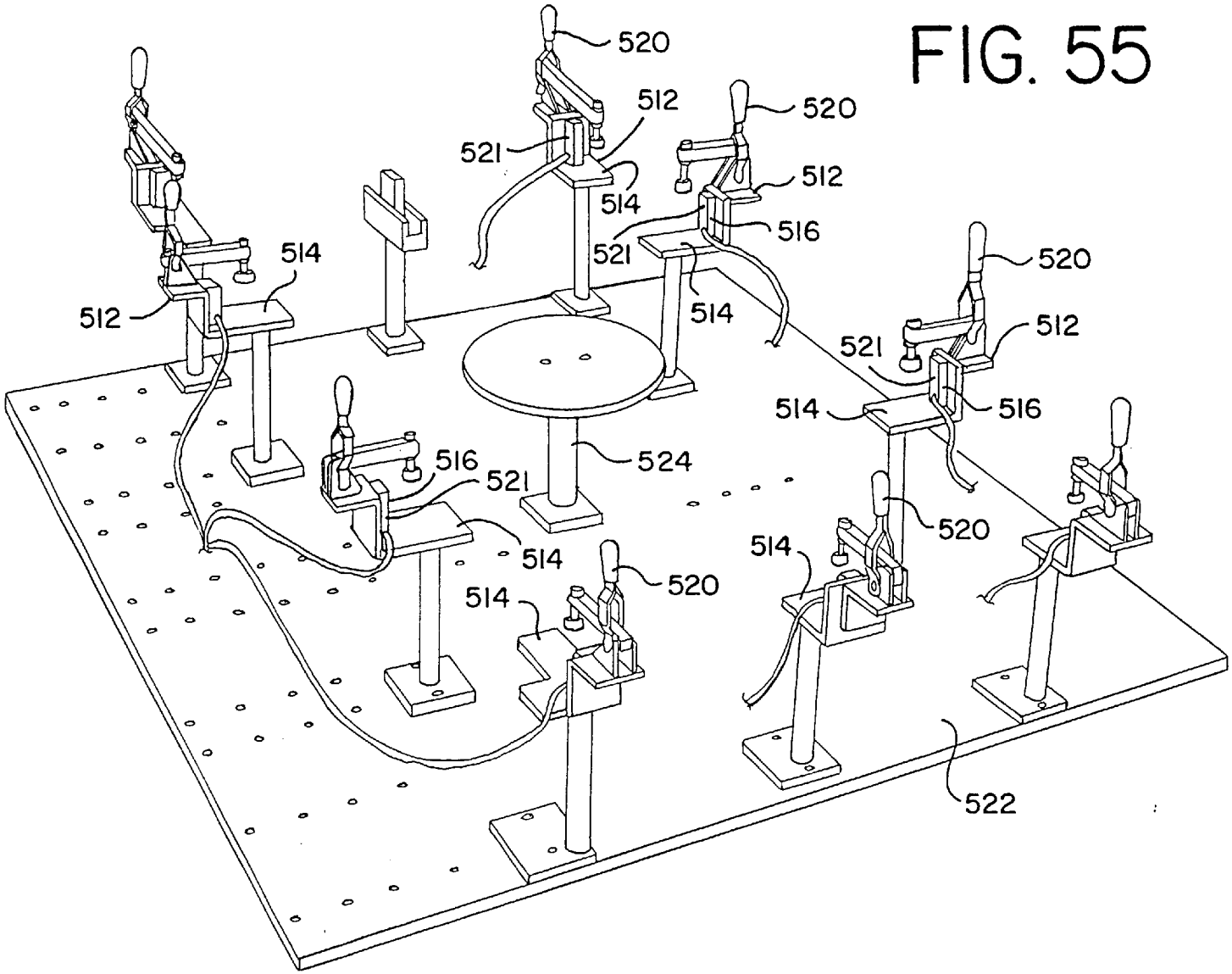
FIG. 55 is a perspective view of the wall panel assembly fixture.
Figures 56, 57:
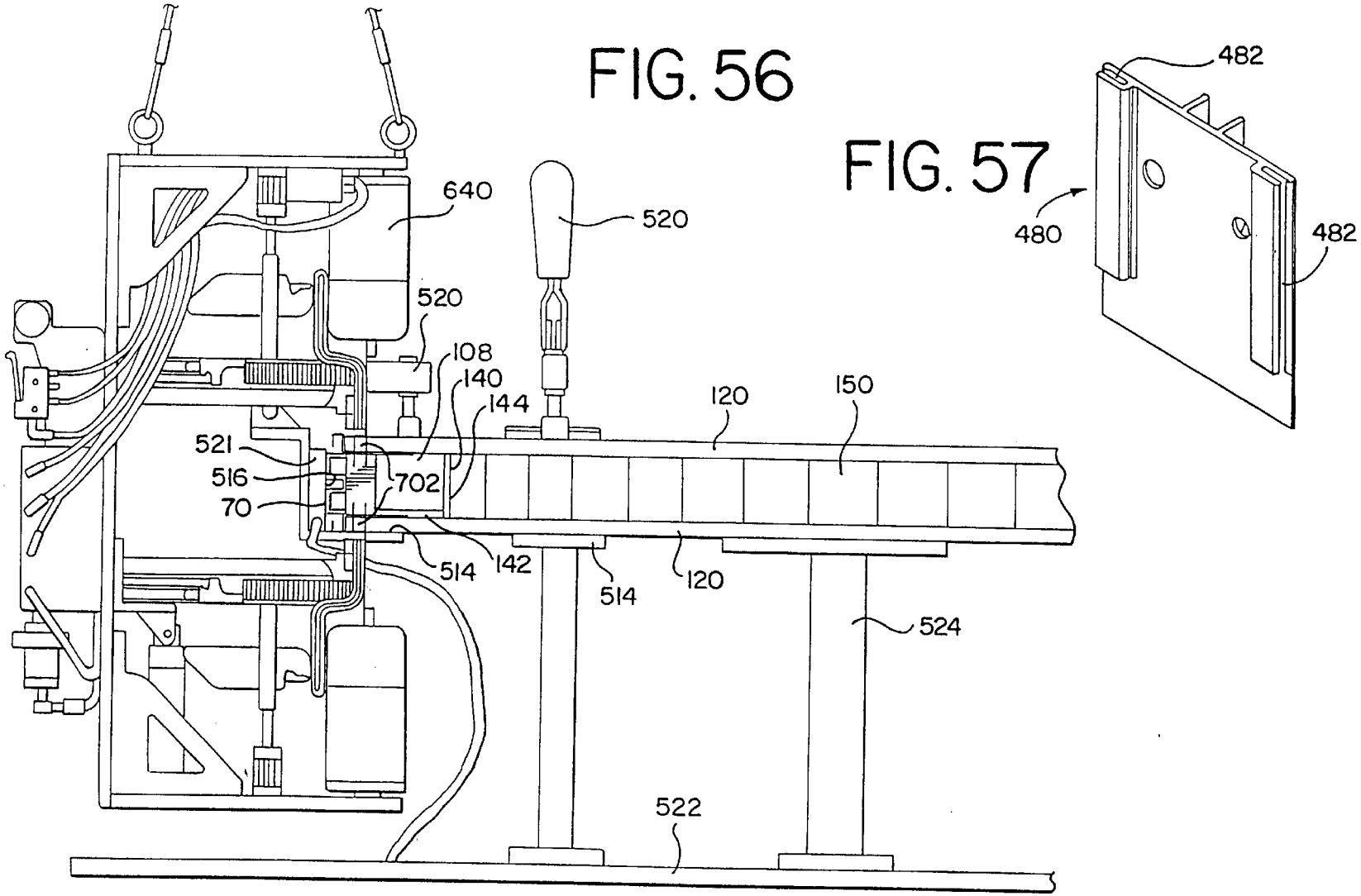
FIG. 56 is a side view of a dual staple gun engaging a wall panel installed in the wall paneassembly fixture.
FIG. 57 is a perspective view of a end cover support bracket.

A method is also provided to assemble the wall panel. The method includes providing a plurality of fixtures 512 having horizontal surfaces 514 and vertical surfaces 516. The fixtures 512 are arranged in a rectangular configuration on a bed 522, as shown in FIGS. 55–56. A pedestal support 524 extends upwardly from the bed in the middle of the fixture arrangement. Each fixture is provided with a clamp 520. Adhesive is applied to the inner surface of one of the wall members around its edge. The wall member is then placed on the horizontal surface 514 of the fixtures with the inner surface facing upward. The pedestal support 524 supports the outer surface of the wall member. The four frame members, i.e., the vertical frame members 14 and the upper and lower frame members 16, 18, are placed in the fixtures such that the sidewalls 34, 36, 38 of each frame engage the fixture surfaces oriented around the panel. The sidewalls of the upper frame member are pinched together and inserted between the upwardly extending sidewalls 68 of the vertical frame members and then released so that the sidewalls overlap. Similarly, the outwardly extending sidewalls 38 of the lower frame member are overlapped with the exposed core of the vertical frame members 550. The vertical surfaces 516 of the fixture are magnetized with magnets 521 to attract and hold the frame members to the vertical surfaces 516.

A partition member 140, with adhesive applied to the mounting flange 142, is then installed at each end of the panel by bonding the mounting flange to the inner surface 122 of the wall member. The boundary flange 144 extends away from the wall member to form the vertical channel 108. Because the partition member is preferably made of cardboard, it can be easily installed by bonding rather than be welding or mechanically fastening as would typically be required for metal or wood partitions.

Adhesive is applied to both sides of the honeycomb filler member 150 and it is disposed inside the frame on the inner surface 122 of the wall member 120. The filler member 150 substantially fills the space between the upper and lower frame members and between the two partition members. In a preferred embodiment, an outlet box 270 is mounted to a hardboard base plate with a fastener. The base plate is adhesively bonded to the inner surface 122 of the wall member. One of a portion of the partition member or filler material is removed to allow the outlet box to be installed on the inside of the frame. The outlet box can be installed between the partition members, or such that one side of the box is aligned with the partition member to thereby provide a wall defining the inner surface of the vertical channel. The conduit 276 connecting the outlet box to the power system is disposed in the vertical channel and extends through the space between the bottom core member and the vertical core member.

Adhesive is applied around the edges of the inner surface 122 of the second wall member. The wall member 120 is positioned in the recess formed on a second side of the frame by the edge portions of the sidewalls. When an outlet box has been installed on the first wall member, a hole is cut in the second wall member so as to be substantially aligned with the outlet box once the second wall member is installed. The two wall members and frame are clamped together and to the fixtures. A staple gun, preferably a dual action staple gun 640 accessing both sides of the panel simultaneously, as shown in FIG. 56, is used to mechanically fasten the two wall members to the four frame members, and in particular, to staple through the wall member and sidewall member and into the core member. Fasteners are also installed in the overlapping portions of the upwardly extending vertical sidewalls, the sidewalls of the upper frame member and the wall member, as described above. As described above, it should be understood that various aspects of this assembly process could be automated. For example, the clamping could be pneumatically controlled, and the positioning of the wall members, filler member, partition members and frame members could be automated.

Because the core members are preferably made out of wood, the wall members can be easily and cheaply secured to the frame. This construction avoids the use of expensive and time consuming welding operations and/or the use of expensive screw and bolt type fasteners.

The support leg is installed by press fitting the upper portion of the leg into the opening between the bracket and core member. The foot member is attached to the leg member.

The barrier sheet is disposed on both sides of the wall panel, and is either adhesively or mechanically attached to the wall member or the frame members. Alternatively, the barrier sheet can be wrapped around the edge portions of the sidewall members underneath the decorative sheet, which secures the barrier sheet to the wall panel, as shown in FIG. 47A.

Next, the decorative sheets are installed by disposing a sheet on each side of the panel and attaching the strip to the edge portion of each side wall as described above, including the steps of tucking the excess fabric corner patch located at the corners into the edge portion channel and inserting a flexible corner block into each corner to secure the fabric in the channel.

It should be understood that all of the aforementioned steps of manufacture can be interchanged without departing from the spirit and scope of the invention. As such, it is intended that the foregoing order of steps be regarded as illustrative rather than limiting.

Additional steps can be included to accessorize the panel. For example, a top cap typically is installed on each panel. In addition, the power distribution system can be installed by attaching the power distribution server, including the receptacle modules and harnesses, to the bracket on the bottom of the lower frame member. In addition, the base cover can be installed on the mounting strip to conceal and protect the power distribution system. The base cover is installed by securing the two side walls to the mounting strip attached to the bottom of the lower frame member.

When assembled in a system of panels, the horizontal channel formed along the top and bottom of the panels provides the user with an ideal and easy to access space for storing and routing cables and wires, such as communication and data lines. Moreover, the vertical channels in each panel allow the user to easily rout wires and cables from the top of the panel to the bottom. In addition, the vertical channels provide a ready-made space for routing electrical conduit from the outlet mounted in the panel to the base of the panel and the attached power distribution system.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A wall panel comprising:

a thin decorative sheet comprising an edge;

said wall panel having an edge;

a strip attached to said sheet adjacent said edge of said sheet, said strip comprising a first and second hook member, wherein said first hook member is disposed on said edge of said wall panel and said second book member is exposed and is adapted to be engaged for moving the strip to a position wherein the first hook member can be removed from or disposed on the edge of the wail panel.

2. The invention of claim 1 wherein said first hook member opens inwardly relative to said edge of said sheet.

3. The invention of claim 2 wherein said edge of said sheet is a folded edge.

4. The invention of claim 3 wherein said folded edge of said sheet is formed by a first portion of said sheet comprising a free edge folded over a second portion of said sheet, and wherein said strip is attached to said first portion of said sheet, said first hook member opening outwardly relative to said free edge prior to said first portion of said sheet being folded over said second portion of said sheet.

5. The invention of claim 4 wherein said sheet comprises an inner and outer surface, wherein said inner surface faces said wall panel, and wherein said strip is attached to said outer surface of said first portion of said sheet prior to said first portion being folded over said second portion.

6. The invention of claim 2 wherein said strip further comprises a first and second side, wherein said first side of said strip faces away from said sheet and wherein said second side is attached to said sheet, wherein said first hook member is disposed on said first side of said strip and said second hook member is disposed on said second side.

7. The invention of claim 2 wherein said second hook member opens inwardly relative to said edge of said sheet.

8. The invention of claim 2 wherein said sheet comprises an inner and outer surface, wherein said inner surface faces said wall panel, and wherein said strip further comprises an end, wherein said second hook member is disposed on said end of said strip and opens outwardly away from said outer surface of said sheet.

9. The invention of claim 1 wherein said strip is attached to said sheet with adhesive.

10. The invention of claims wherein said strip is sewn to said sheet.

11. The invention of claim 1 wherein said sheet comprises four edges and wherein said strip comprises four strips attached to said sheet adjacent said four edges respectively.

12. A wall panel covering comprising:

a thin decorative sheet comprising an edge defining a periphery of said sheet;

a strip attached to said sheet adjacent said edge of said sheet, said strip comprising a portion extending outwardly from said edge beyond said periphery of said sheet and a first and second hook member, wherein said first hook member is adapted to engage a wall panel and said second hook member is disposed on said portion of said strip extending outwardly from said edge of said sheet and is adapted to be engaged by a user such that the engagement with said second hook member by the user urges said first hook member into a position wherein it can be engaged and disengaged with the wall panel;

said edge of said sheet is a folded edge, wherein said folded edge of said sheet is formed by a first portion of said sheet comprising a free edge folded over a second portion of said sheet, and wherein said strip is attached to said first portion of said sheet, said first hook member opening outwardly relative to said free edge prior to said first portion of said sheet being folded over said second portion of said sheet.

13. The invention of claim wherein said first hook member opens inwardly relative to said edge of said sheet.

14. The invention of claim 12 wherein said sheet comprises a first and second surface, wherein said strip is attached to said first surface of said first portion of said sheet prior to said first portion being folded over said second portion.

15. The invention of claim 12 wherein said strip further comprises a first and second side, wherein said first side of said strip faces away from said sheet and wherein said second side is attached to said sheet, wherein said first hook member is disposed on said first side of said strip and said second hook member is disposed on said second side.

16. The invention of claim 13 wherein said second hook member opens inwardly relative to said edge of said sheet.

17. The invention of claim 12 wherein said strip further comprises an end, wherein said second hook member is disposed on said end of said strip and opens outwardly away from said sheet.

18. The invention of claim 12 wherein said strip is attached to said sheet with adhesive.

19. The invention of claim 12 wherein said strip is sewn to said sheet.

20. The invention of claim 12 wherein said sheet comprises four edges and wherein said strip comprises four strips attached to said sheet adjacent said four edges respectively.

21. The invention of claim 14 wherein said second surface of said first portion faces said second surface of said second portion when said first portion is folded over said second portion and wherein said first surface of said first portion and said first surface of said second portion face in opposite directions.

22. A method for covering at least a portion of a wall panel comprising:

providing a thin decorative sheet comprising an edge defining a periphery of said sheet and a strip attached to said sheet adjacent said edge of said sheet and extending outwardly from said edge beyond said periphery of said sheet, said strip comprising a first hook member and a second hook member, wherein said second hook member is disposed on said outwardly extending portion of said strip;

engaging said second hook member with a positioning member;

moving said strip with said positioning member such that said first hook member is positioned to engage an edge of said wall panel;

engaging said edge of said wall panel with said first hook member;

disengaging said positioning member from said hook member; and further comprising reengaging said second hook member with said positioning member and disengaging said first hook member from said edge of said wall panel.

23. The invention of claim 22 wherein said positioning member comprises a tool.

24. The invention of claim 22 wherein said first hook member opens inwardly relative to said edge of said sheet.

25. The invention of claim 24 wherein said second hook member opens inwardly relative to said edge of said sheet.

26. The invention of claim 24 wherein said sheet has opposite surfaces and wherein said second hook member opens outwardly away from one of said opposite surfaces.

* * * * *

UNITED STATES PATENT AND TRADEMARK OFFICE

CERTIFICATE OF CORRECTION

PATENT NO. : 6,314,687 B1
DATED : November 13, 2001
INVENTOR(S) : Gerald Schondelmayer et al.

It is certified that error appears in the above-identified patent and that said Letters Patent is hereby corrected as shown below:

Column 22,
Line 11, delete “wail” and substitute -- wall -- in its place.
Line 19, delete “book” and substitute -- hook -- in its place.
Line 56, delete “claims” and substitute -- claim 1 -- in its place.

Column 23,
Line 16, after “claim” insert -- 12 --.

Signed and Sealed this

Twenty-sixth Day of November, 2002

*Attest:*

*Attesting Officer*

JAMES E. ROGAN
*Director of the United States Patent and Trademark Office*